US007837038B2

(12) United States Patent
Chang et al.

(10) Patent No.: US 7,837,038 B2
(45) Date of Patent: Nov. 23, 2010

(54) GIFT PACKAGE HAVING CIRCUIT ACTUATING CAPABILITY

(75) Inventors: Han-Chao Chang, Tainan (TW); Jen-Lin Chen, 11648 Birch Spring Ct., Cupertino, CA (US) 95014

(73) Assignee: Jen-Lin Chen, Cupertino, CA (US)

( * ) Notice: Subject to any disclaimer, the term of this patent is extended or adjusted under 35 U.S.C. 154(b) by 104 days.

(21) Appl. No.: 12/444,233

(22) PCT Filed: Aug. 16, 2007

(86) PCT No.: PCT/US2007/076090

§ 371 (c)(1), (2), (4) Date: Apr. 3, 2009

(87) PCT Pub. No.: WO2008/051653

PCT Pub. Date: May 2, 2008

(65) Prior Publication Data

US 2010/0089786 A1 Apr. 15, 2010

(30) Foreign Application Priority Data

Oct. 26, 2006 (DE) ..... 20 2006 016 582 U

(51) Int. Cl.
*B65D 85/00* (2006.01)

(52) U.S. Cl. ..... 206/573; 206/459.1

(58) Field of Classification Search ..... 206/573, 206/459.1, 232, 457, 525, 706, 708; 220/500, 220/529, 694

See application file for complete search history.

(56) References Cited

U.S. PATENT DOCUMENTS

| | | | | | |
|---|---|---|---|---|---|
| 4,363,081 | A * | 12/1982 | Wilbur | ..... | 206/232 |
| 5,118,196 | A * | 6/1992 | Ault et al. | ..... | 362/123 |
| 5,973,250 | A * | 10/1999 | Zirille et al. | ..... | 84/600 |
| 6,112,442 | A * | 9/2000 | Liang | ..... | 206/525 |
| 6,844,686 | B1 * | 1/2005 | Schneck et al. | ..... | 315/185 S |
| 2001/0011495 | A1 * | 8/2001 | Song | ..... | 84/600 |

* cited by examiner

*Primary Examiner*—J. Gregory Pickett

(57) ABSTRACT

A gift package includes: a box body having a partitioning plate dividing an inner space in the box body into first and second chambers and adapted to abut against an article, the box body being provided with a lid for covering and uncovering an access opening of the box body; a signal output unit mounted in the second chamber; a circuit board mounted securely in the second chamber and provided with a controller that is electrically coupled to the signal output unit for controlling activation and deactivation of the signal output unit; and a switch operable through a selected one of the lid and the article to activate the signal output unit.

12 Claims, 26 Drawing Sheets

GIFT PACKAGE HAVING CIRCUIT ACTUATING CAPABILITY

CROSS-REFERENCE TO RELATED APPLICATIONS

This is the U.S. National Phase Application under 35 U.S.C. §371 of International Patent Application No. PCT/US2007/076090 filed Aug. 16, 2007 and claims priority of German Utility Model Application No. DE 20 2006 016 582.7, filed on Oct. 26, 2006, both of which are incorporated by reference herein in their entireties.

BACKGROUND OF THE INVENTION

1. Field of the Invention

This invention relates to a gift package with circuit actuating capability, more particularly to a gift package having a control circuit that controls generation of signal(s), such as an acoustic effect or a light effect, through a circuit actuating unit.

2. Description of the Related Art

Conventional wine bottle gift packages are normally configured as a box made of a cardboard material and covered by a lid, and are wrapped with a decorative paper and decorated with an ornament to enhance the appearance thereof for presenting as a gift.

SUMMARY OF THE INVENTION

The object of the present invention is to provide a gift package including a control circuit that controls generation of signal(s) through a circuit actuating unit so as to enhance appeal of the gift package.

According to the present invention, there is provided a gift package having circuit actuating capability and adapted to receive an article of a gift therein. The gift package comprises: a box body defining an inner space therein and having an open end defining an access opening, and a partitioning plate that divides the inner space into first and second chambers, the first chamber being adapted to accommodate the article therein, the partitioning plate being adapted to abut against the article, the box body being provided with a lid for covering and uncovering the access opening of the box body; a signal output unit mounted in the second chamber; a control circuit including a circuit board mounted securely in the second chamber and provided with a controller that is electrically coupled to the signal output unit for controlling activation and deactivation of the signal output unit; and a circuit actuating unit including a switch that is coupled electrically to the control circuit, that is mounted on the box body, and that is operable through a selected one of the lid and the article in such a manner that performing a selected one of operations of uncovering the access opening and removing the article from the partitioning plate enables the controller to activate the signal output unit through the switch.

BRIEF DESCRIPTION OF THE DRAWINGS

In drawings which illustrate embodiments of the invention.

DETAILED DESCRIPTION OF THE PREFERRED EMBODIMENTS

Figure 1A:
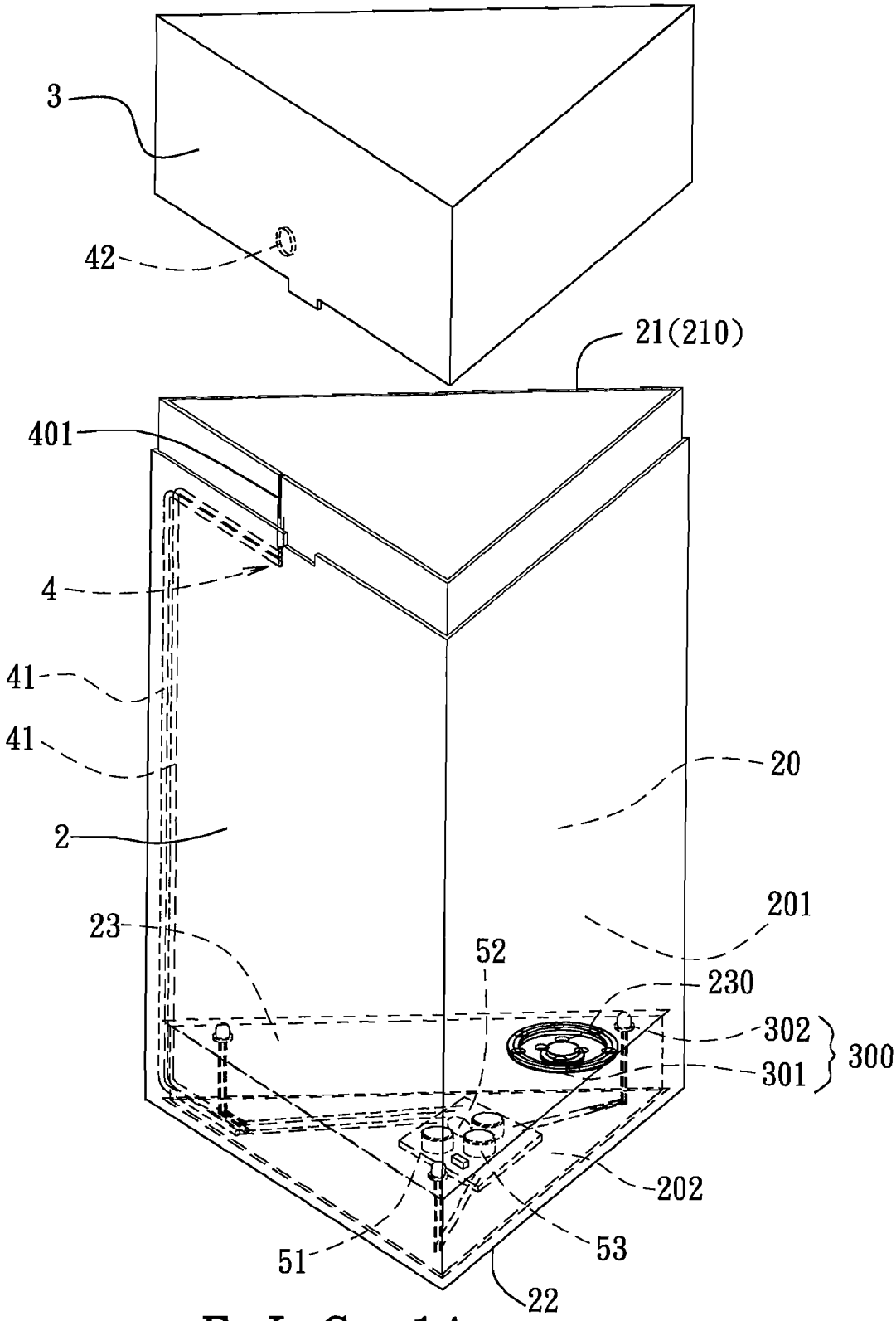
FIG. 1A is a perspective view of the first preferred embodiment of a gift package according to this invention, illustrating a state where the gift package is opened.

Before the present invention is described in greater detail, it should be noted that same reference numerals have been used to denote like elements throughout the specification.

Figure 1B:
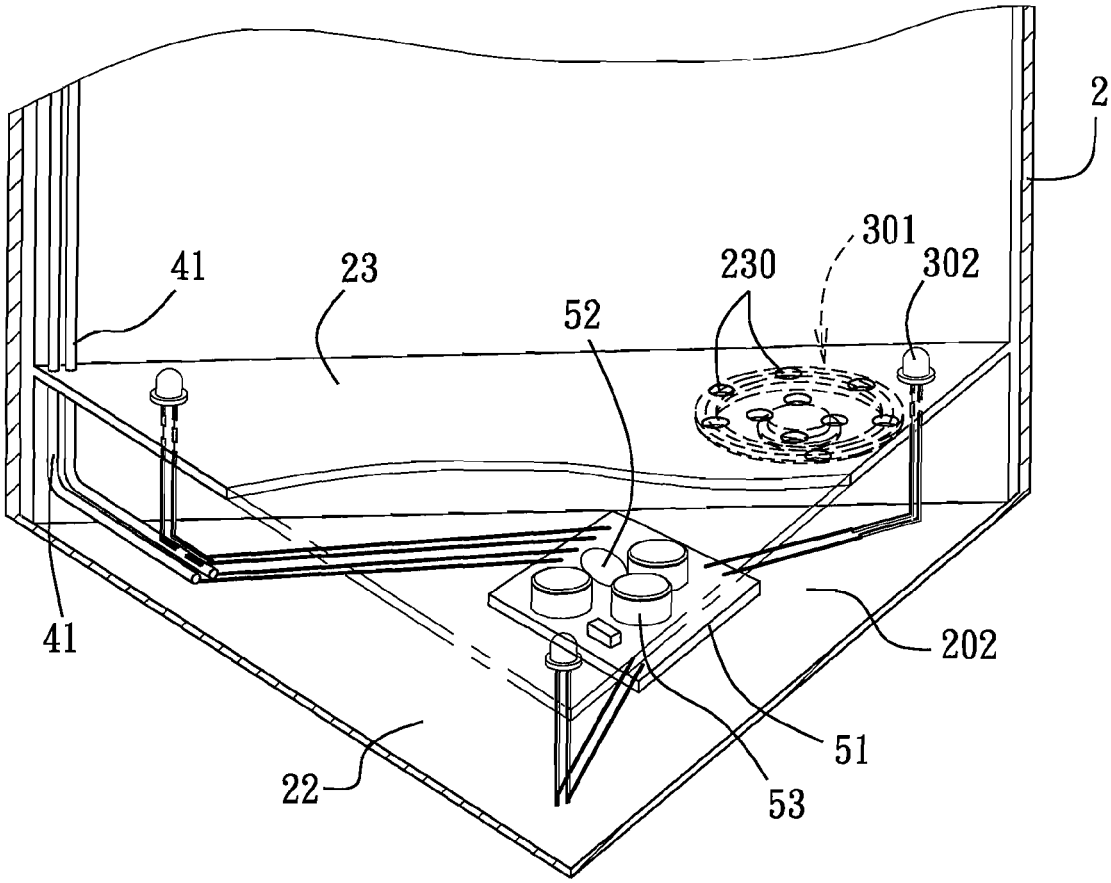
FIG. 1B is a fragmentary cutaway view of the first preferred embodiment.

FIGS. 1A and 1B illustrate the first preferred embodiment of a gift package with circuit actuating capability according to this invention for receiving an article of a gift, such as a wine bottle, therein.

The gift package of this embodiment includes: a box body 2 defining an inner space 20 therein and having an open end 21 defining an access opening 210, a closed end 22 opposite to the open end 21, and a partitioning plate 23 that divides the inner space 20 into first and second chambers 201, 202, the first chamber 201 extending from the partitioning plate 23 to the open end 21 and being adapted to accommodate the article (not shown) therein, the second chamber 202 extending from the partitioning plate 23 to the closed end 22, the partitioning plate 23 being adapted to support the article thereon, the box body 2 being provided with a lid 3 for covering and uncovering the access opening 210 of the box body 2; a signal output unit 300 mounted in the second chamber 202; a control circuit including a circuit board 51 mounted securely in the second chamber 202 and provided with an IC controller 52 that is electrically coupled to the signal output unit 300 and that has a control circuit for controlling activation and deactivation of the signal output unit 300; and a circuit actuating unit including a switch 4 that is coupled electrically to the IC controller 52 of the control circuit, that is mounted on the box body 2, and that is operable through a selected one of the lid 3 and the article in such a manner that performing a selected one of operations of uncovering the access opening 210 and removing the article from the partitioning plate 23 enables the IC controller 52 to activate the signal output unit 300 through the switch 4 (note that, in this embodiment, the IC controller 52 is enabled through the uncovering of the access opening 210).

In this embodiment, the circuit board 51 is mounted securely on the closed end 22 of the box body 2 within the second chamber 202. The circuit actuating unit further includes a pair of conductive lines 41 extending between and interconnecting the switch 4 and the circuit board 51 so that electrical connection and disconnection between the conductive lines 41, which correspond respectively to activation and deactivation of the signal output unit 300, is controlled by the switch 4 through the IC controller 52.

In this embodiment, the switch 4 is a reed switch 401 mounted on the box body 2 and disposed adjacent to the access opening 210 of the box body 2. Alternatively, the switch 4 can be a semiconductor magnetic sensitive switch, such as a semiconductor magnetic sensitive resistor, a semiconductor magnetic sensitive diode, or a semiconductor magnetic sensitive transistor. The circuit actuating unit further includes a magnet 42 mounted on the lid 3 for coupling magnetically to the reed switch 401 when the lid 3 covers the access opening 210 so that covering and uncovering of the access opening 210 respectively result in magnetic engagement and disengagement between the magnet 42 and the reed switch 401, which, in turn, respectively result in electrical connection and disconnection between the conductive lines 41. A plurality of button batteries 53 are provided on the circuit board 51. The signal output unit 300 includes a speaker 301 and three LEDs 302. The speaker 301 is mounted to a bottom side of the partitioning plate 23, which is formed with a plurality of sound holes 230.

In this embodiment, the box body 2 is triangular in shape, and the reed switch 401 is disposed at a middle of one side of the box body 2. Correspondingly, the magnet 42 is disposed at a middle of one side of the lid 3.

Figure 1C:
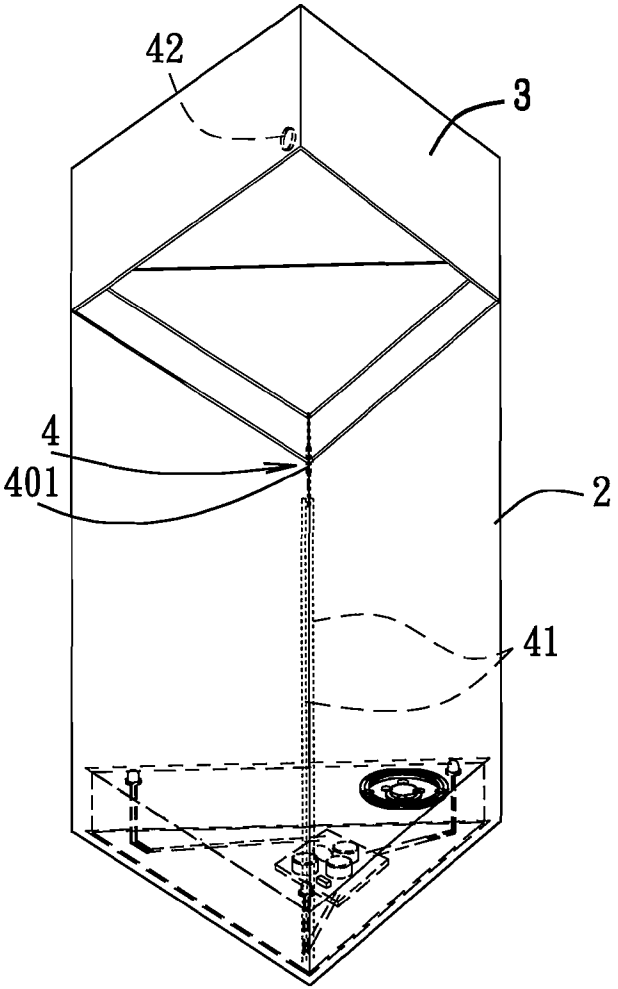
FIG. 1C is a perspective view of the second preferred embodiment of a gift package according to this invention, illustrating a state where the gift package is opened.

FIG. 1C illustrates the second preferred embodiment of the gift package according to this invention. The second preferred embodiment differs from the previous embodiment in that the reed switch 401 is disposed at a corner of the box body 2. The magnet 42 is correspondingly disposed at one corner of the lid 3.

Figure 2A:
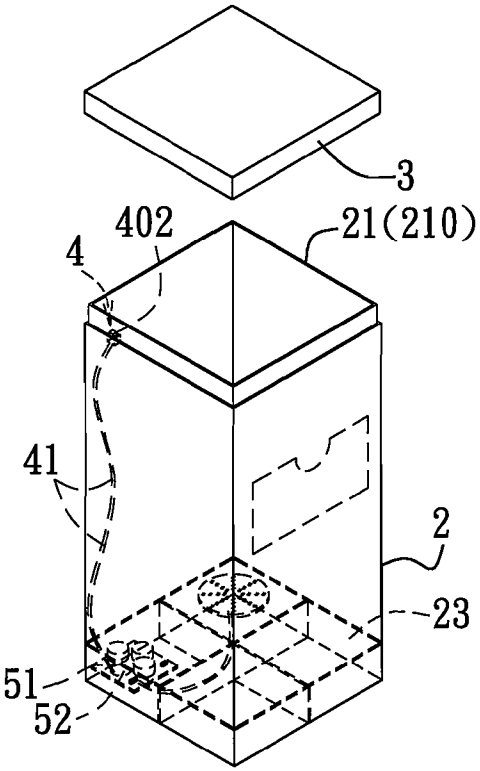
FIG. 2A is a perspective view of the third preferred embodiment of the gift package according to this invention, illustrating a state where the gift package is opened.
Figure 2B:
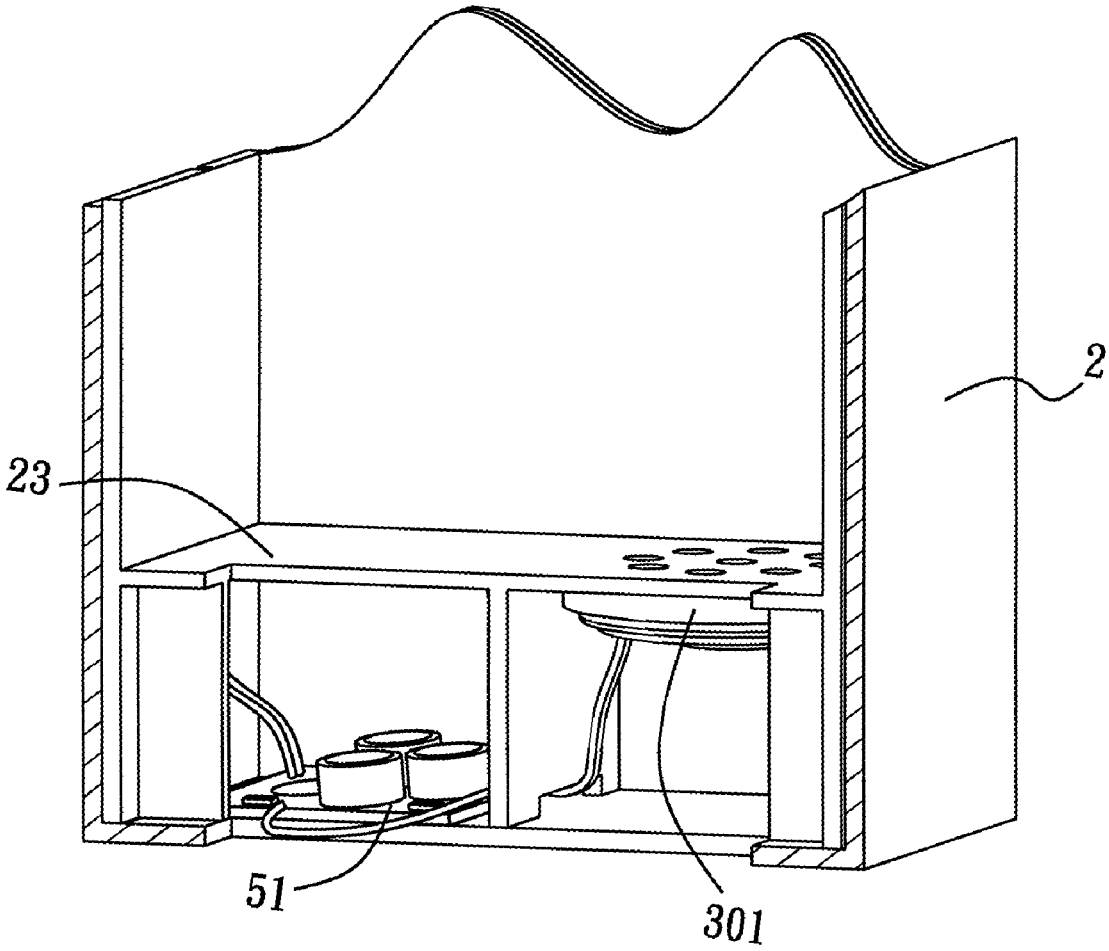
FIG. 2B is a fragmentary perspective view of the third preferred embodiment.

FIGS. 2A and 2B illustrate the third preferred embodiment of the gift package according to this invention. The third preferred embodiment differs from the previous embodiments mainly in that the box body 2 is rectangular in shape and that the switch 4 is a micro switch 402 mounted on the box body 2 and disposed adjacent to the access opening 210 of the box body 2 so that covering and uncovering of the access opening 210 respectively result in contact and separation between the lid 3 and the micro switch 402, which, in turn, respectively result in electrical connection and disconnection between the conductive lines 41.

Figure 2D:
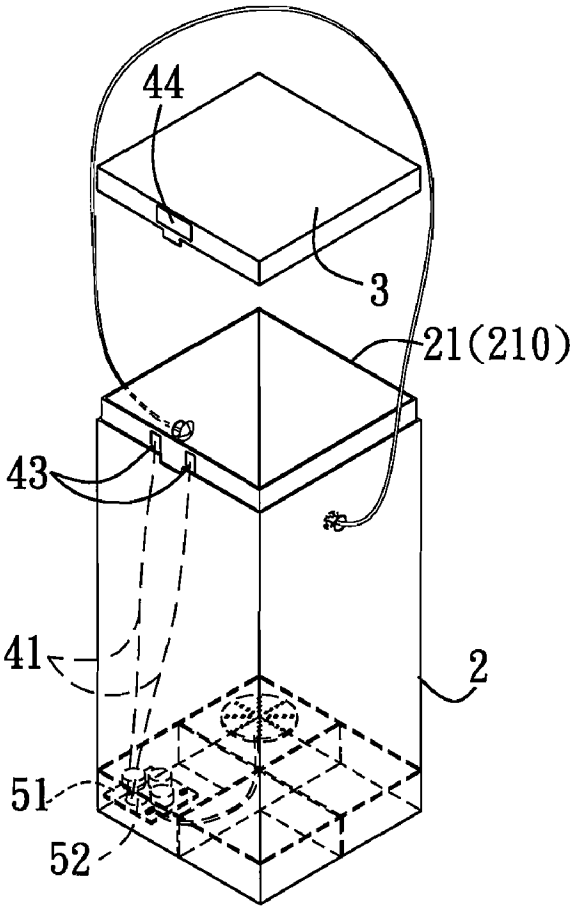
FIG. 2D is a perspective view of the fifth preferred embodiment of the gift package according to this invention, illustrating a state where the gift package is opened.
Figure 2C:
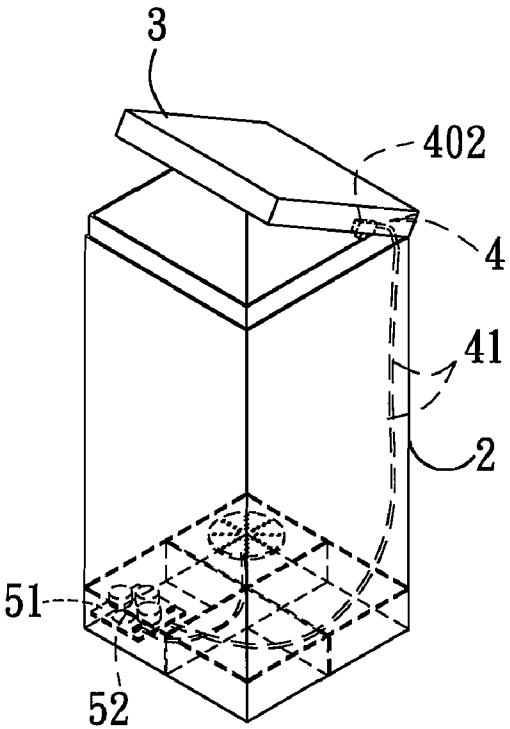
FIG. 2C is a perspective view of the fourth preferred embodiment of the gift package according to this invention, illustrating a state where the gift package is opened.

FIG. 2C illustrates the fourth preferred embodiment of the gift package according to this invention. The fourth preferred embodiment differs from the third embodiment in that the micro switch 402 is mounted on the lid 3.

FIG. 2D illustrates the fifth preferred embodiment of the gift package according to this invention. The fifth preferred embodiment differs from the previous embodiments mainly in that the switch 4 includes a pair of spaced apart first conductive contacts 43 that are disposed on the box body 2 adjacent to the open end 21 of the box body 2 and that are respectively connected to the conductive lines 41, and a second conductive contact 44 that is disposed on the lid 3 for bridging the first conductive contacts 43 when the lid 3 covers the access opening 210 so that covering and uncovering of the access opening 210 respectively result in electrical connection and disconnection between the conductive lines 41. In addition, the conductive lines 41 are in the form of wires. In this embodiment, the first conductive contacts 43 are formed on one side of the box body 2.

Figure 2G:
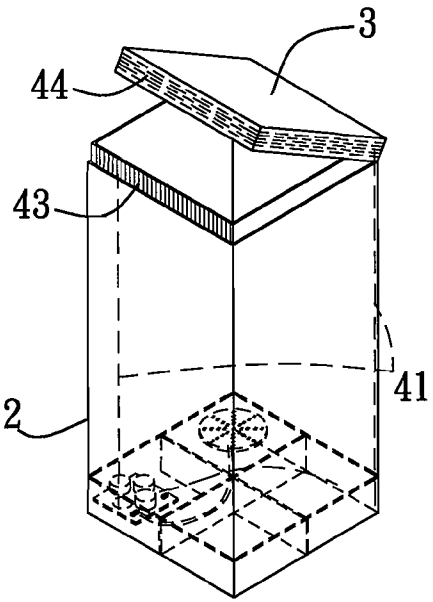
FIG. 2G is a perspective view of the eighth preferred embodiment of the gift package according to this invention, illustrating a state where the gift package is opened.
Figure 2F:
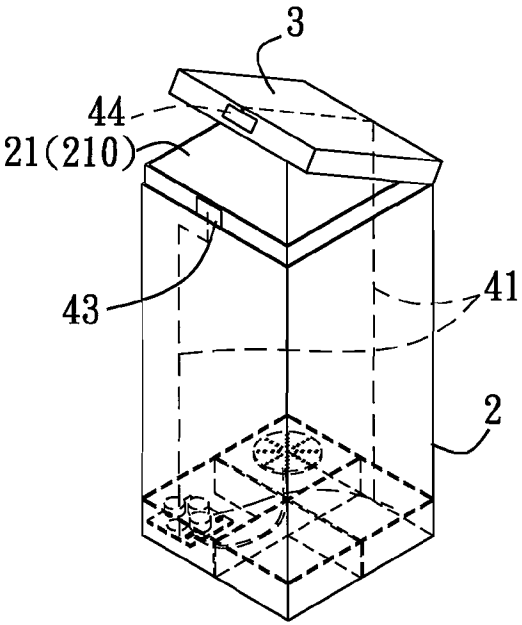
FIG. 2F is a perspective view of the seventh preferred embodiment of the gift package according to this invention, illustrating a state where the gift package is opened.
Figure 2E:
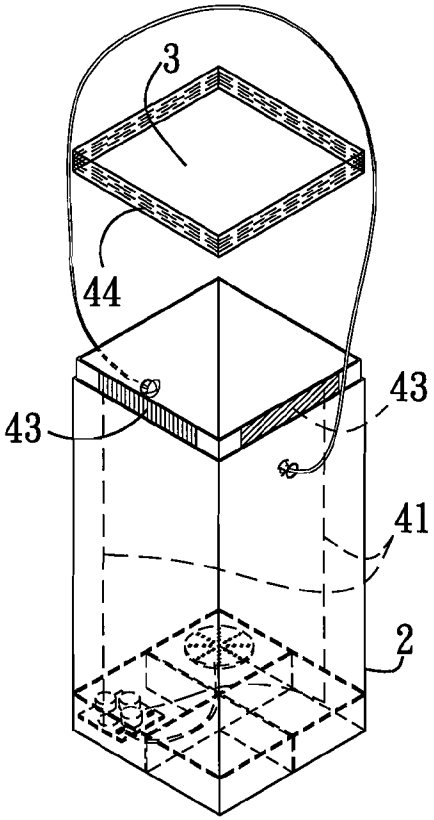
FIG. 2E is a perspective view of the sixth preferred embodiment of the gift package according to this invention, illustrating a state where the gift package is opened.

FIG. 2E illustrates the sixth preferred embodiment of the gift package according to this invention. The sixth preferred embodiment differs from the fifth embodiment in that each of the first and second conductive contacts 43, 44 is formed of a printed conductive ink and that the first conductive contacts 43 are formed at two adjacent sides of the box body 2. In addition, the second conductive contact 44 is formed on all four sides of the interior of the lid 3.

FIG. 2F illustrates the seventh preferred embodiment of the gift package according to this invention. The seventh preferred embodiment differs from the fifth embodiment in that the switch 4 includes a first conductive contact 43 that is disposed on the box body 2 adjacent to the open end 21 of the box body 2 and that is connected electrically to one of the conductive lines 41, and a second conductive contact 44 that is disposed on the lid 3 and that is connected electrically to the other of the conductive lines 41 for contacting the first conductive contact 43 when the lid 3 covers the access opening 210 so that covering and uncovering of the access opening 210 respectively result in electrical connection and disconnection between the conductive lines 41.

FIG. 2G illustrates the eighth preferred embodiment of the gift package according to this invention. The eighth preferred embodiment differs from the seventh embodiment in that each of the first and second conductive contacts 43, 44 is formed of a printed conductive ink, that the first conductive contact 43 is formed on the box body 2, and that the second conductive contact 44 is formed on sides of the interior of the lid 3.

Figure 3B:
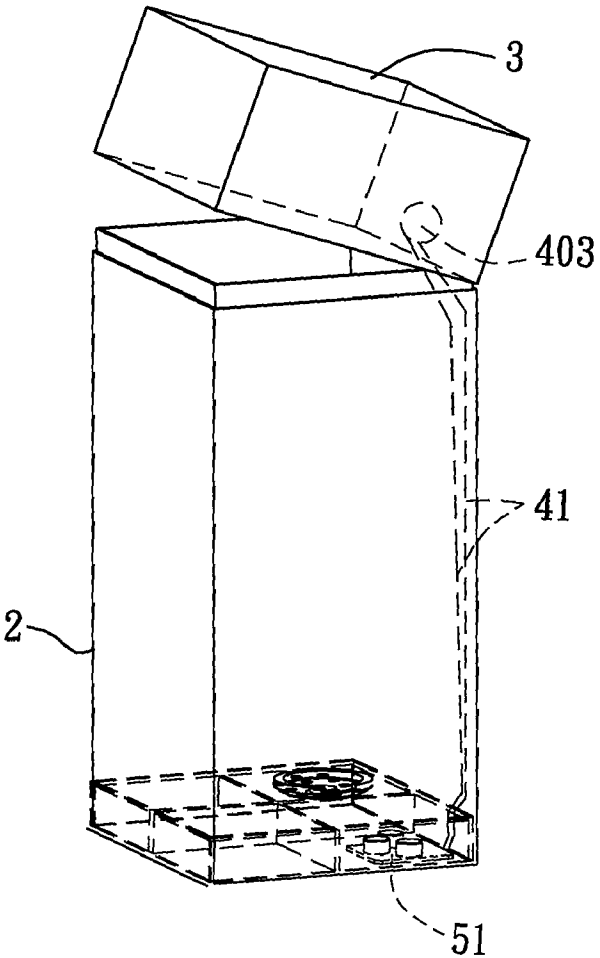
FIG. 3B is a perspective view of the tenth preferred embodiment of the gift package according to this invention, illustrating a state where the gift package is opened.
Figure 3A:
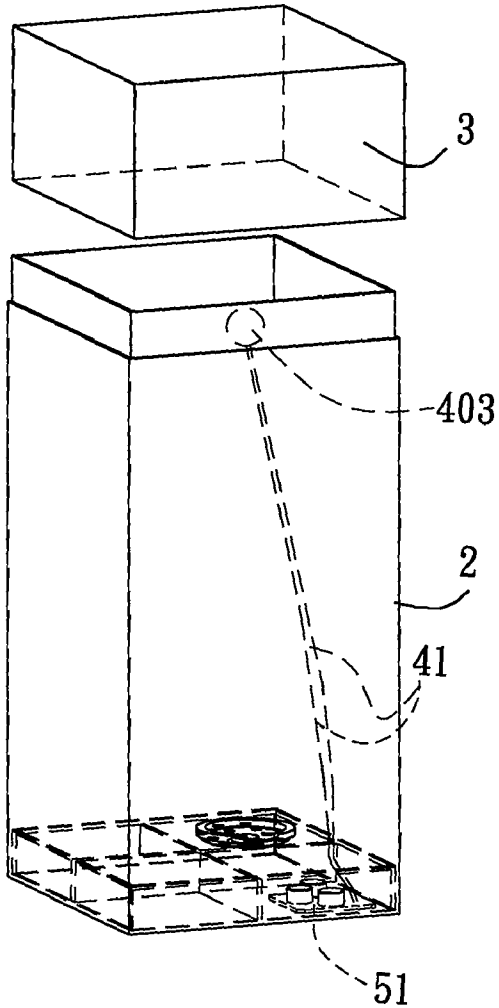
FIG. 3A is a perspective view of the ninth preferred embodiment of the gift package according to this invention, illustrating a state where the gift package is opened.

FIG. 3A illustrates the ninth preferred embodiment of the gift package according to this invention. The ninth preferred embodiment differs from the first embodiment mainly in that the switch 4 is a light sensor 403 disposed on the box body 2 adjacent to the open end 21 of the box body 2, connected electrically to the conductive lines 41, and covered by the lid 3 when the lid 3 covers the access opening 210 so that covering and uncovering of the access opening 210 respectively result in electrical connection and disconnection between the conductive lines 41.

FIG. 3B illustrates the tenth preferred embodiment of the gift package according to this invention. The tenth preferred embodiment differs from the ninth embodiment in that the light sensor 403 is mounted on an interior of the lid 3.

The switch 4 for each of the first preferred embodiment to the tenth preferred embodiment is operated through covering and uncovering of the access opening 210 by the lid 3, while the switch 4 for each of the eleventh preferred embodiment to the sixteenth preferred embodiment, which will be described in greater detail in the following paragraphs, is operated through placing and removal of the article on and from the partitioning plate 23.

Figure 4:
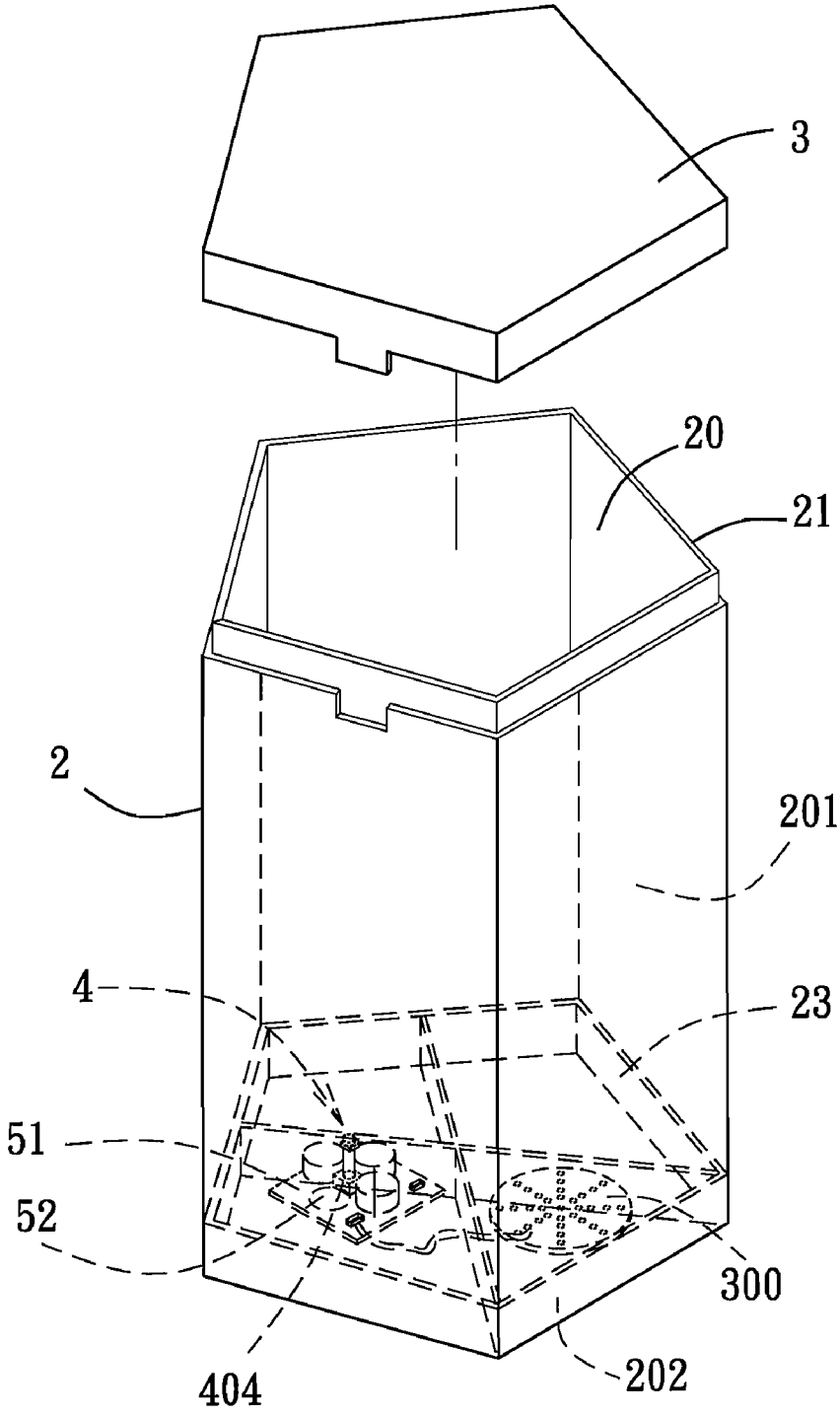
FIG. 4 is a perspective view of the eleventh preferred embodiment of the gift package according to this invention, illustrating a state where the gift package is opened.

FIG. 4 illustrates the eleventh preferred embodiment of the gift package according to this invention. The eleventh preferred embodiment differs from the previous embodiments mainly in that the switch 4 includes a weight sensor 404 that is mounted on the circuit board 51, that is electrically connected to the IC controller 52, and that is disposed below and that abuts against the partitioning plate 23. The partitioning plate 23 is mounted movably in the inner space 20 in the box body 2 so that placing of the article on the partitioning plate 23 and removal of the article from the partitioning plate 23 respectively result in downward and upward movements of the partitioning plate 23, which, in turn, respectively result in activation and deactivation of the signal output unit 300.

Figure 5:
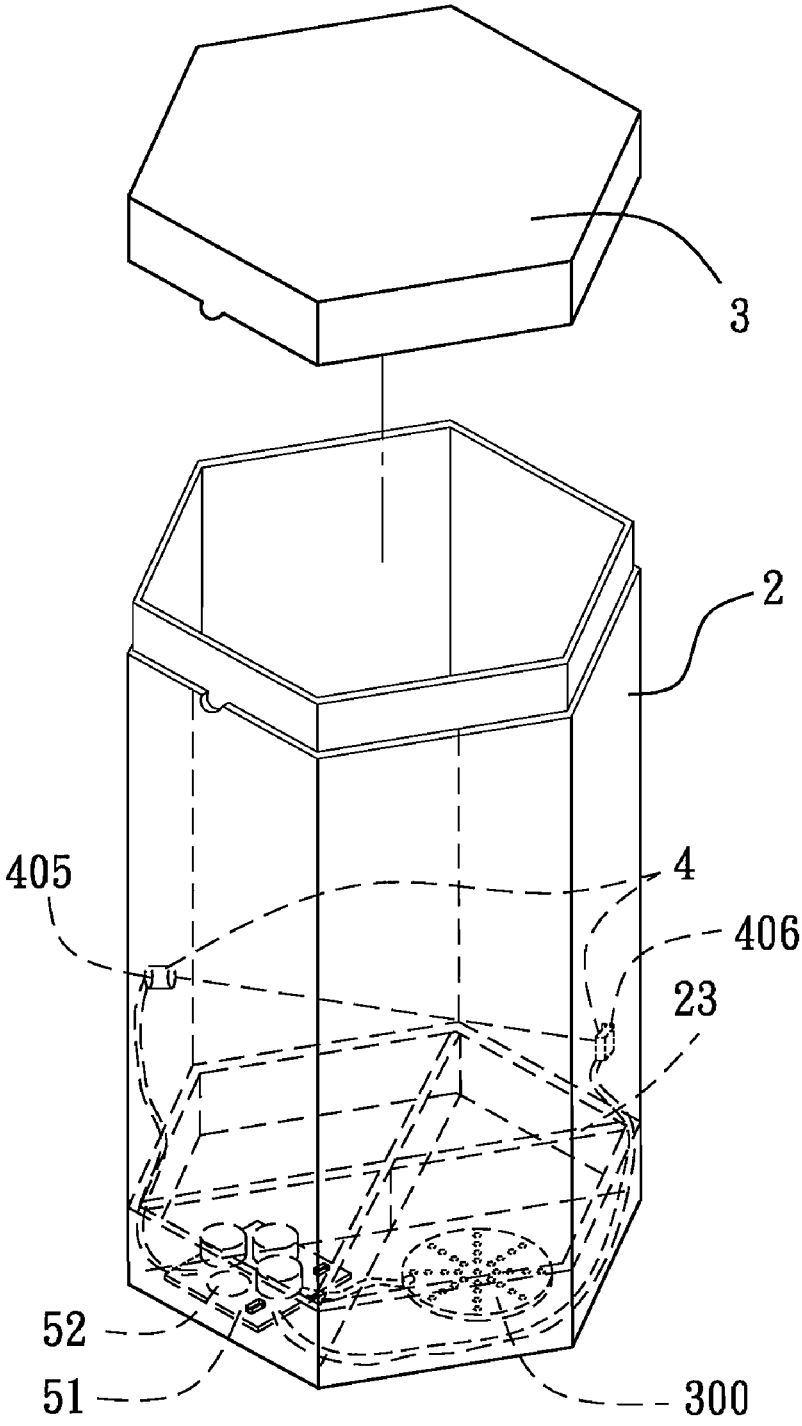
FIG. 5 is a perspective view of the twelfth preferred embodiment of the gift package according to this invention, illustrating a state where the gift package is opened.

FIG. 5 illustrates the twelfth preferred embodiment of the gift package according to this invention. The twelfth preferred embodiment differs from the eleventh embodiment in that the switch 4 includes an emitter 405 mounted on an interior of the box body 2 in the first chamber 201 and connected electrically to the IC controller 52, and a receiver 406 mounted on the interior of the box body 2, connected electrically to the IC controller 52, and disposed opposite to the emitter 405 for receiving signals from the emitter 405 so that placing of the article on the partitioning plate 23 and removal of the article from the partitioning plate 23 respectively result in blocking and unblocking of the signals from the emitter 405, which, in turn, respectively result in activation and deactivation of the signal output unit 300.

Figure 6B:
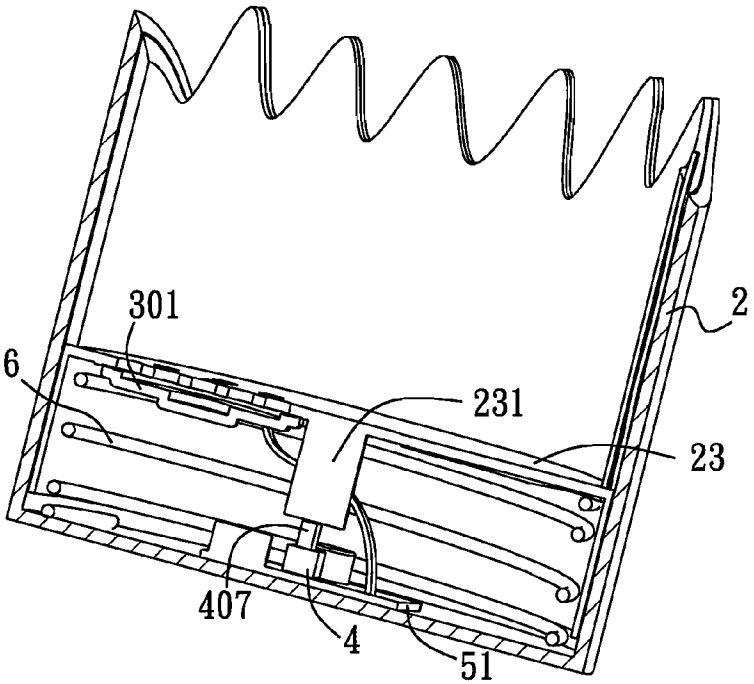
FIG. 6B is a fragmentary perspective view of the thirteenth preferred embodiment.
Figure 6A:
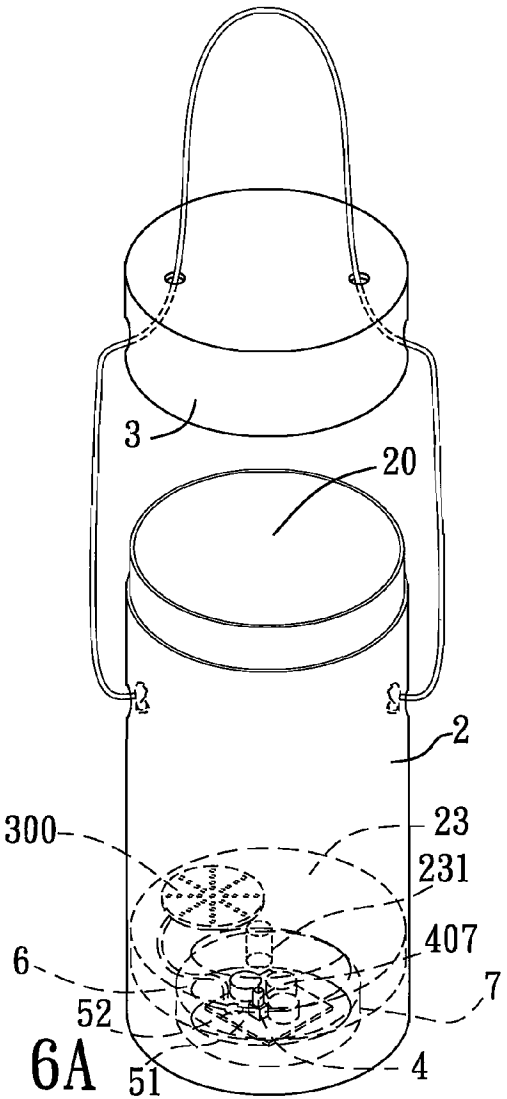
FIG. 6A is a perspective view of the thirteenth preferred embodiment of the gift package according to this invention, illustrating a state where the gift package is opened.

FIGS. 6A and 6B illustrate the thirteenth preferred embodiment of the gift package according to this invention. The thirteenth preferred embodiment differs from the previous embodiments mainly in that the switch 4 is mounted on the circuit board 51, is connected electrically to the IC controller 52, and includes a pressable button 407. In this embodiment, the partitioning plate 23 is mounted movably in the inner space 20 in the box body 2 and is formed with a pushing stud 231 protruding from a bottom side thereof toward the pressable button 407. The gift package further includes an urging member 6 that urges the partitioning plate 23 to move in a direction away from the pressable button 407 so that placing of the article on the partitioning plate 23 and removal of the article from the partitioning plate 23 respectively result in downward and upward movements of the partitioning plate 23, which, in turn, respectively result in pressing and non-pressing of the pushing stud 231 against the pressable button 407, which, in turn, respectively result in activation and deactivation of the signal output unit 300. A protective shore 7 is provided to surround the circuit board 51 for protecting the latter and the electronic components mounted thereon.

Figure 6D:
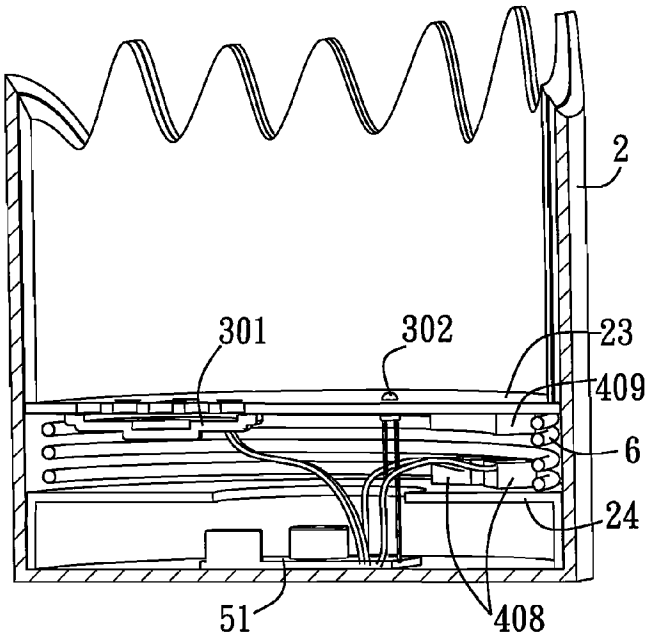
FIG. 6D is a fragmentary perspective view of the fourteenth preferred embodiment.
Figure 6C:
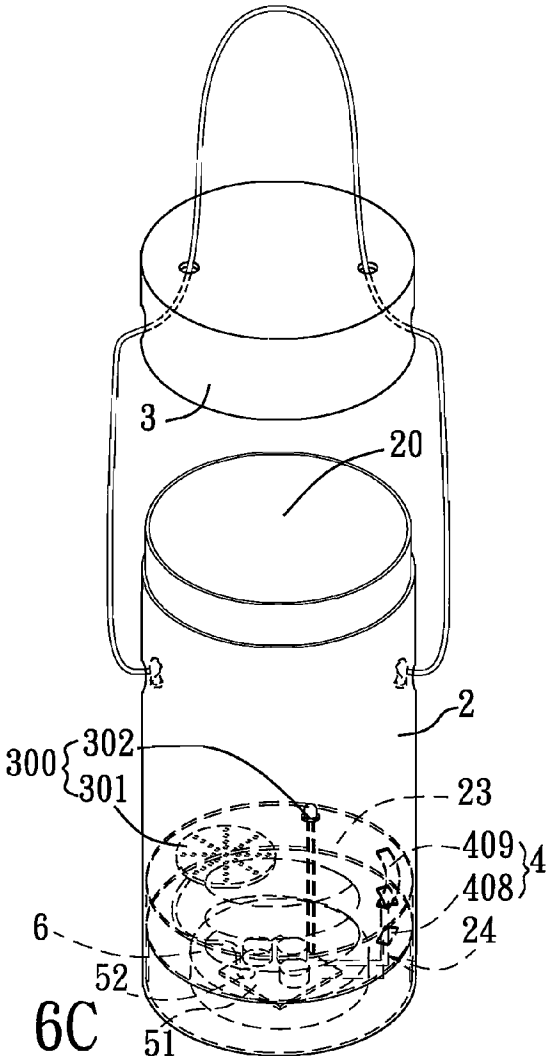
FIG. 6C is a perspective view of the fourteenth preferred embodiment of the gift package according to this invention, illustrating a state where the gift package is opened.

FIGS. 6C and 6D illustrate the fourteenth preferred embodiment of the gift package according to this invention. The fourteenth preferred embodiment differs from the thirteenth embodiment in that the gift package further includes a fixed plate 24 disposed below the partitioning plate 23, and an urging member 6 disposed between and urging against the partitioning plate 23 and the fixed plate 24. In this embodiment, the switch 4 includes a pair of spaced apart first conductive contacts 408 that are mounted on one of the partitioning plate 23 and the fixed plate 24 (in this embodiment, the first conductive contacts 408 are mounted on the fixed plate 24) and that are connected electrically to the IC controller 52, and a second conductive contact 409 that is mounted on the other of the partitioning plate 23 and the fixed plate 24 (in this embodiment, the second conductive contact 409 is mounted on the partitioning plate 23), and that faces the first conductive contacts 408 for bridging the first conductive contacts 408. The partitioning plate 23 is movably mounted in the inner space 20 in the box body 2 so that placing of the article on the partitioning plate 23 and removal of the article from the partitioning plate 23 respectively result in downward and upward movements of the partitioning plate 23, which, in turn, respectively result in electrical connection and disconnection of the second conductive contact 409 to and from the first conductive contacts 408, which, in turn, respectively result in activation and deactivation of the signal output unit 300.

Figure 6E:
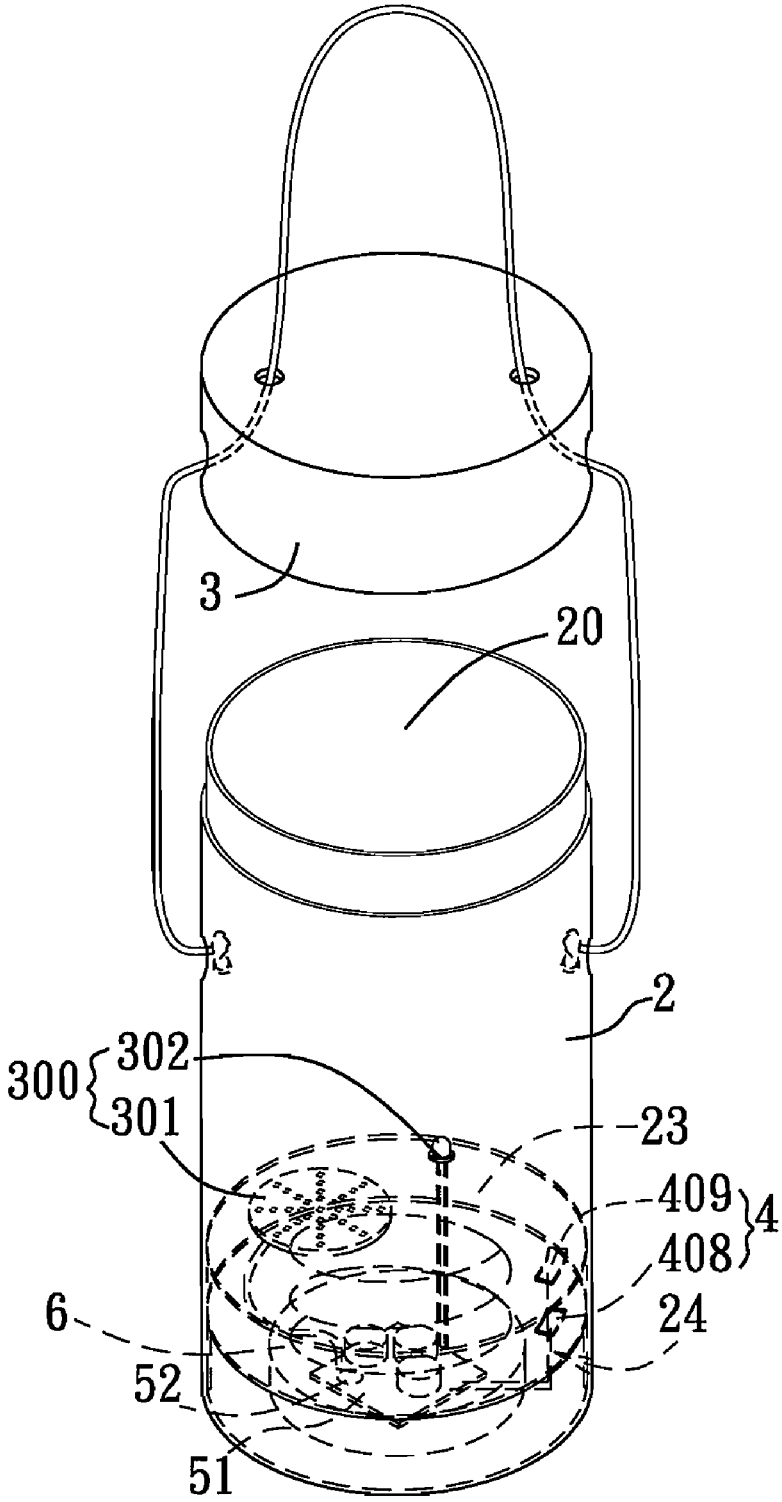
FIG. 6E is a perspective view of the fifteenth preferred embodiment of the gift package according to this invention, illustrating a state where the gift package is opened.

FIG. 6E illustrates the fifteenth preferred embodiment of the gift package according to this invention. The fifteenth preferred embodiment differs from the fourteenth embodiment in that the switch 4 includes a first conductive contact 408 that is mounted on the fixed plate 24 and that is connected electrically to the IC controller 52, and a second conductive contact 409 that is mounted on the partitioning plate 23, that is connected electrically to the IC controller 52, and that faces the first conductive contact 408 for contacting the latter when the partitioning plate 23 is moved downwardly due to placing of the article thereon.

Figure 6G:
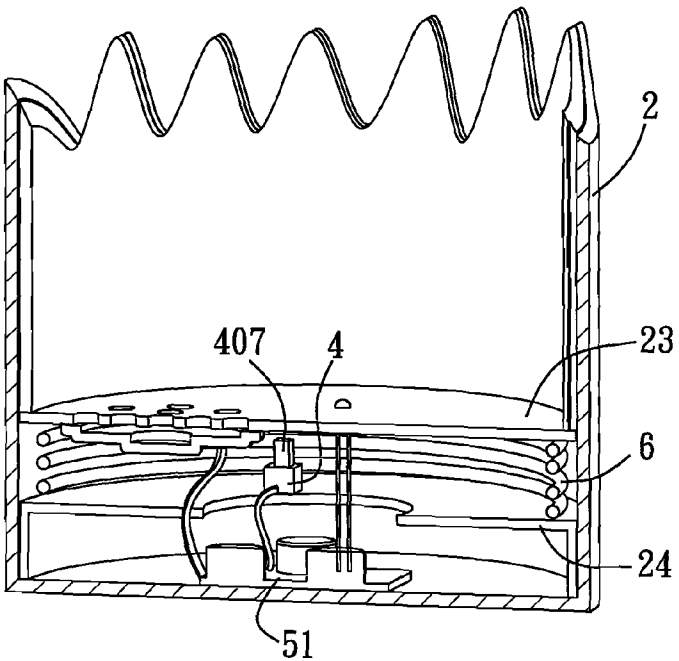
FIG. 6G is a fragmentary perspective view of the sixteenth preferred embodiment.
Figure 6F:
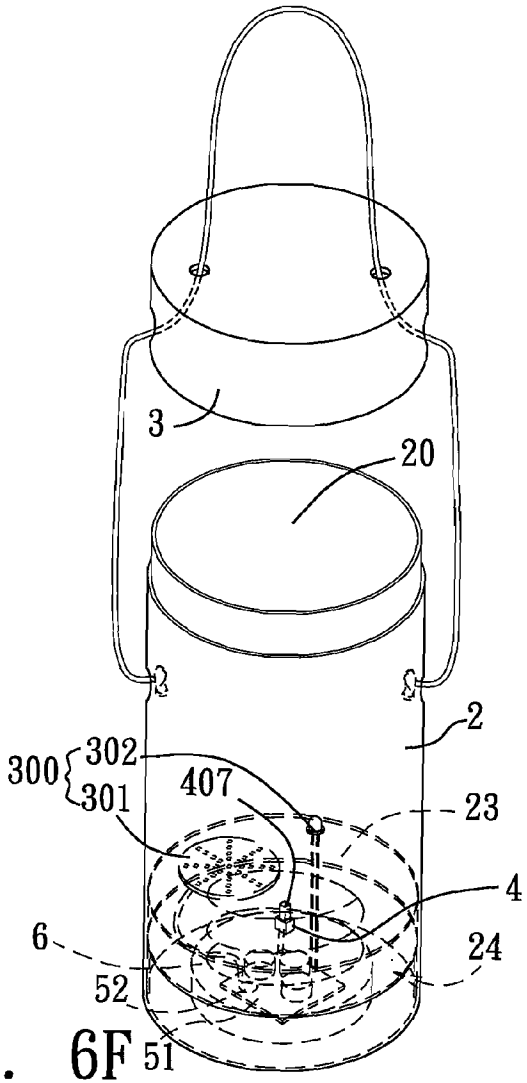
FIG. 6F is a perspective view of the sixteenth preferred embodiment of the gift package according to this invention, illustrating a state where the gift package is opened.

FIGS. 6F and 6G illustrate the sixteenth preferred embodiment of the gift package according to this invention. The sixteenth preferred embodiment differs from the thirteenth embodiment in that the gift package further includes a fixed plate 24 disposed below the partitioning plate 23, and an urging member 6 disposed between and urging against the partitioning plate 23 and the fixed plate 24, and that the switch 4 is mounted on the fixed plate 24 instead. The partitioning plate 23 is mounted movably in the inner space 20 in the box body 2 so that placing of the article on the partitioning plate 23 and removal of the article from the partitioning plate 23 respectively result in downward and upward movements of the partitioning plate 23, which, in turn, respectively result in pressing and non-pressing of the pressable button 407, which, in turn, respectively result in activation and deactivation of the signal output unit 300.

Among the switches of the previous embodiments, the reed switch 401 and the semiconductor magnetic sensitive switches are advantageous in that they are flat and have a relatively small size, which, when embedded in the box body 2 or the lid 3, cannot be seen from the outside of the gift package. Moreover, these switches are actuated at an ideal separating distance between the lid 3 and the open end 21 of the box body 2, which ranges from 3 mm to 5 mm, i.e., the effect that the gift package want to bring forth is most remarkable at this separating distance range. The following seventeenth to twentieth preferred embodiments differ from the previous embodiments in that the preferred embodiment includes two switches for respectively controlling at least one circuit state (such as activation the speaker, the LEDs, or other electronic components) and/or at least one operating state (such as on and off states) of the control circuit.

Figure 7B:
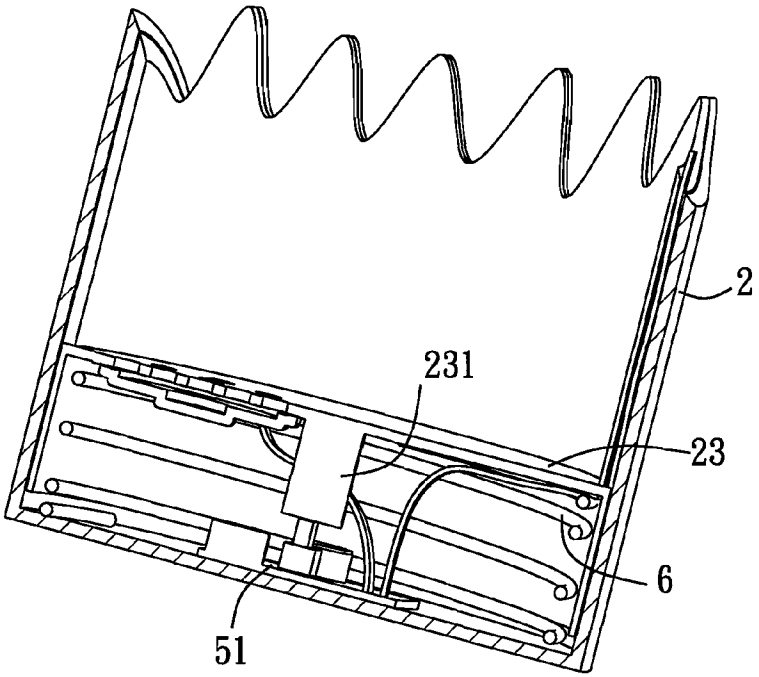
FIG. 7B is a fragmentary perspective view of the seventeenth preferred embodiment.
Figure 7A:
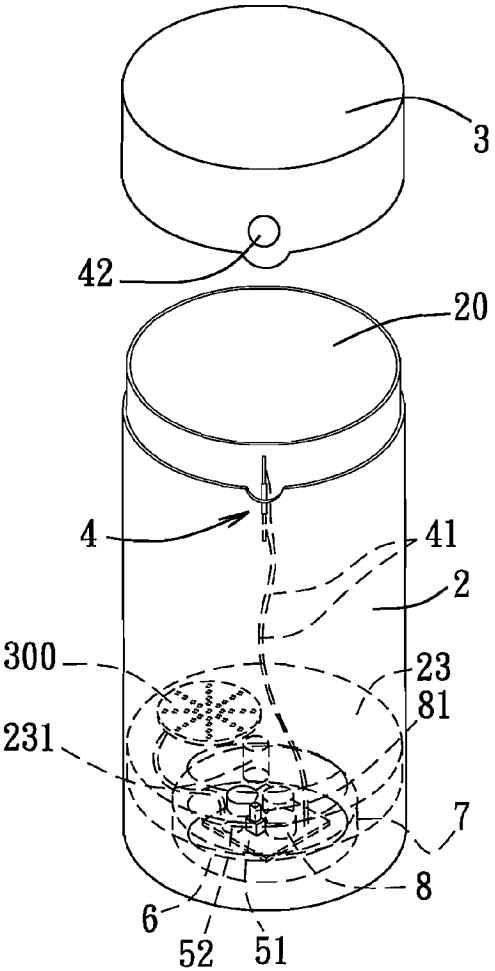
FIG. 7A is a perspective view of the seventeenth preferred embodiment of the gift package according to this invention, illustrating a state where the gift package is opened.

FIGS. 7A and 7B illustrate the seventeenth preferred embodiment of the gift package according to this invention. The seventeenth preferred embodiment is a combination of the first preferred embodiment and the thirteenth preferred embodiment. In this preferred embodiment, the first switch 4 has the same function as that of the first preferred embodiment, and the second switch 8 has the same structure similar to that of the thirteenth preferred embodiment, is mounted on the circuit board 51, is connected electrically to the IC controller 52, and includes a pressable button 81 for controlling one of the circuit states of the control circuit other than that controlled by the first switch 4. The partitioning plate 23 is mounted movably in the inner space 20 in the box body 2 and is formed with a pushing stud 231 protruding therefrom toward the pressable button 81. The gift package further includes an urging member 6 that urges the partitioning plate 23 to move in a direction away from the pressable button 81 so that placing of the article on the partitioning plate 23 and removal of the article from the partitioning plate 23 respectively result in downward and upward movements of the partitioning plate 23, which, in turn, respectively result in pressing and non-pressing of the pushing stud 231 against the pressable button 81. Note that the second switch 8 is associated with the first switch 4 in such a manner that the second switch 8 can be enabled only when the first switch 4 is actuated so as to prevent undesired actuation of the second switch 8 during transport or inversion of the gift package.

Figure 8B:
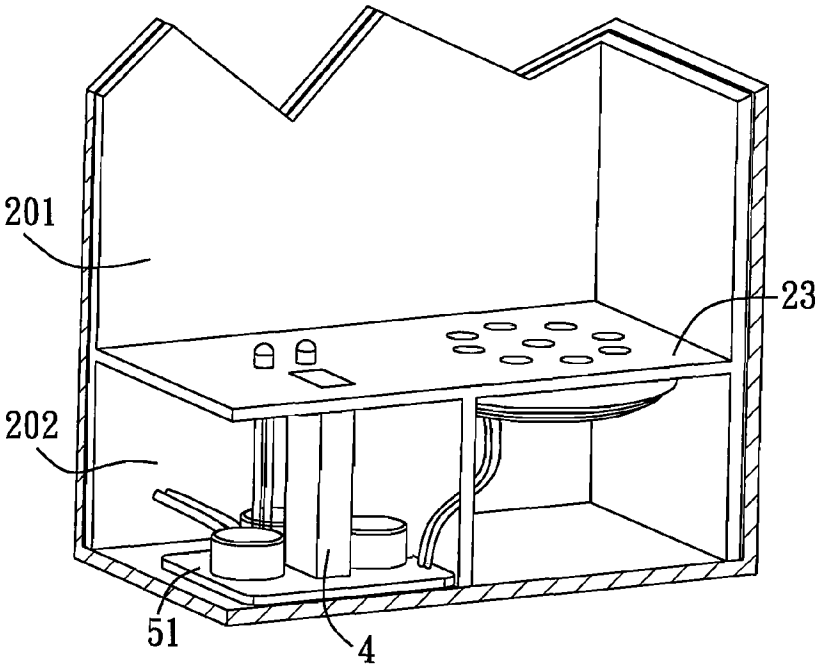
FIG. 8B is a fragmentary perspective view of the eighteenth preferred embodiment.
Figure 8A:
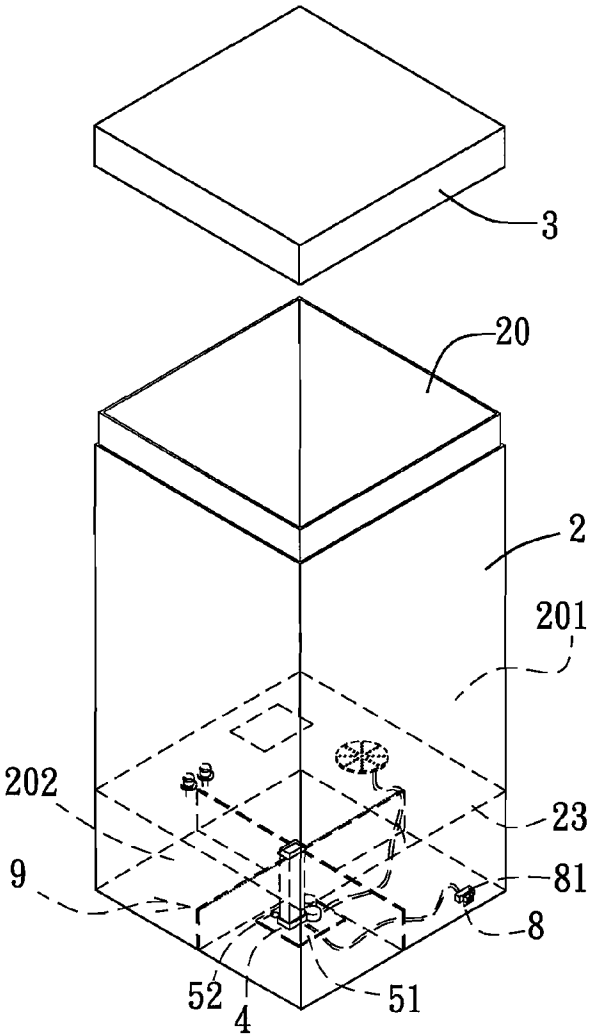
FIG. 8A is a perspective view of the eighteenth preferred embodiment of the gift package according to this invention, illustrating a state where the gift package is opened.

FIGS. 8A and 8B illustrate the eighteenth preferred embodiment of the gift package according to this invention. The eighteenth preferred embodiment differs from the eleventh preferred embodiment in that the gift package further includes a second switch 8 (in this embodiment, the second switch is an On/Off switch) that is mounted on the box body 2, that is connected electrically to the circuit board 51, and that includes a pressable button 81 disposed at an exterior of the box body 2 for controlling on and off states of the control circuit. A crisscross partitioning wall 9 is mounted in the second chamber 202 so as to divide the second chamber 202 into four compartments for respectively accommodating different parts, such as speaker, LEDs, circuit board, and the batteries.

Figure 9B:
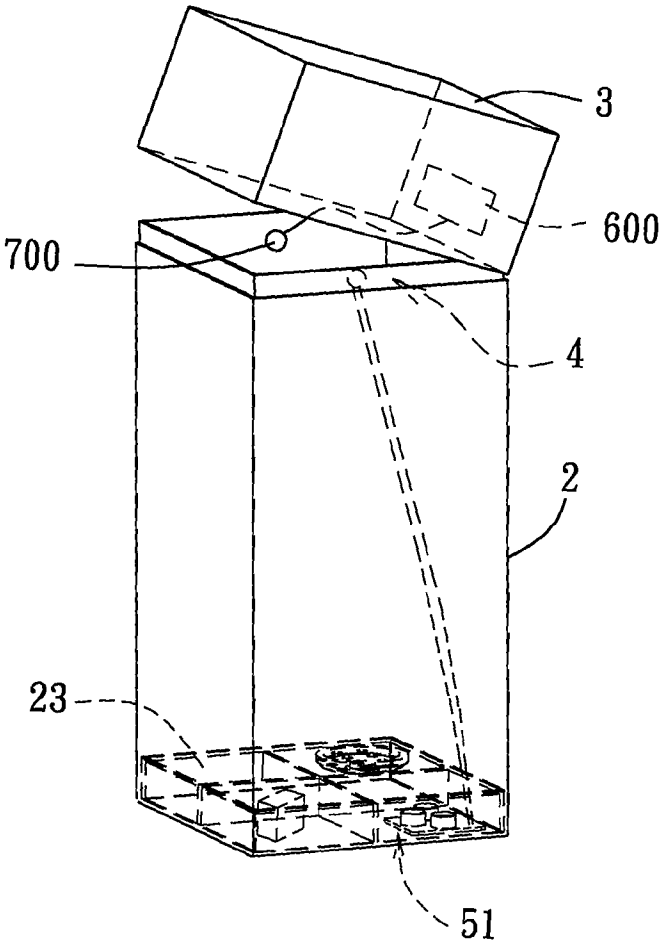
FIG. 9B is a perspective view of the twentieth preferred embodiment of the gift package according to this invention, illustrating a state where the gift package is opened.
Figure 9A:
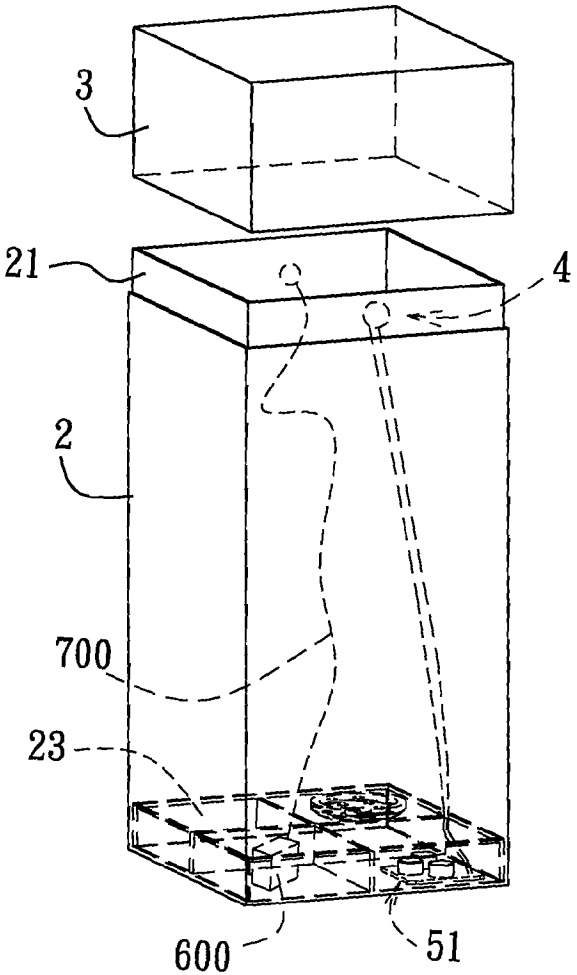
FIG. 9A is a perspective view of the nineteenth preferred embodiment of the gift package according to this invention, illustrating a state where the gift package is opened.

FIG. 9A illustrates the nineteenth preferred embodiment of the gift package according to this invention. The nineteenth preferred embodiment differs from the ninth preferred embodiment in that the gift package further includes a screamer 600 that is mounted in the second chamber 202, and a string 700 connected to the screamer 600 and extending therefrom to the open end 21 of the box body 2.

FIG. 9B illustrates the twentieth preferred embodiment of the gift package according to this invention. The twentieth preferred embodiment differs from the nineteenth preferred embodiment in that the screamer is mounted on an interior of the lid 3 instead.

Figure 10:
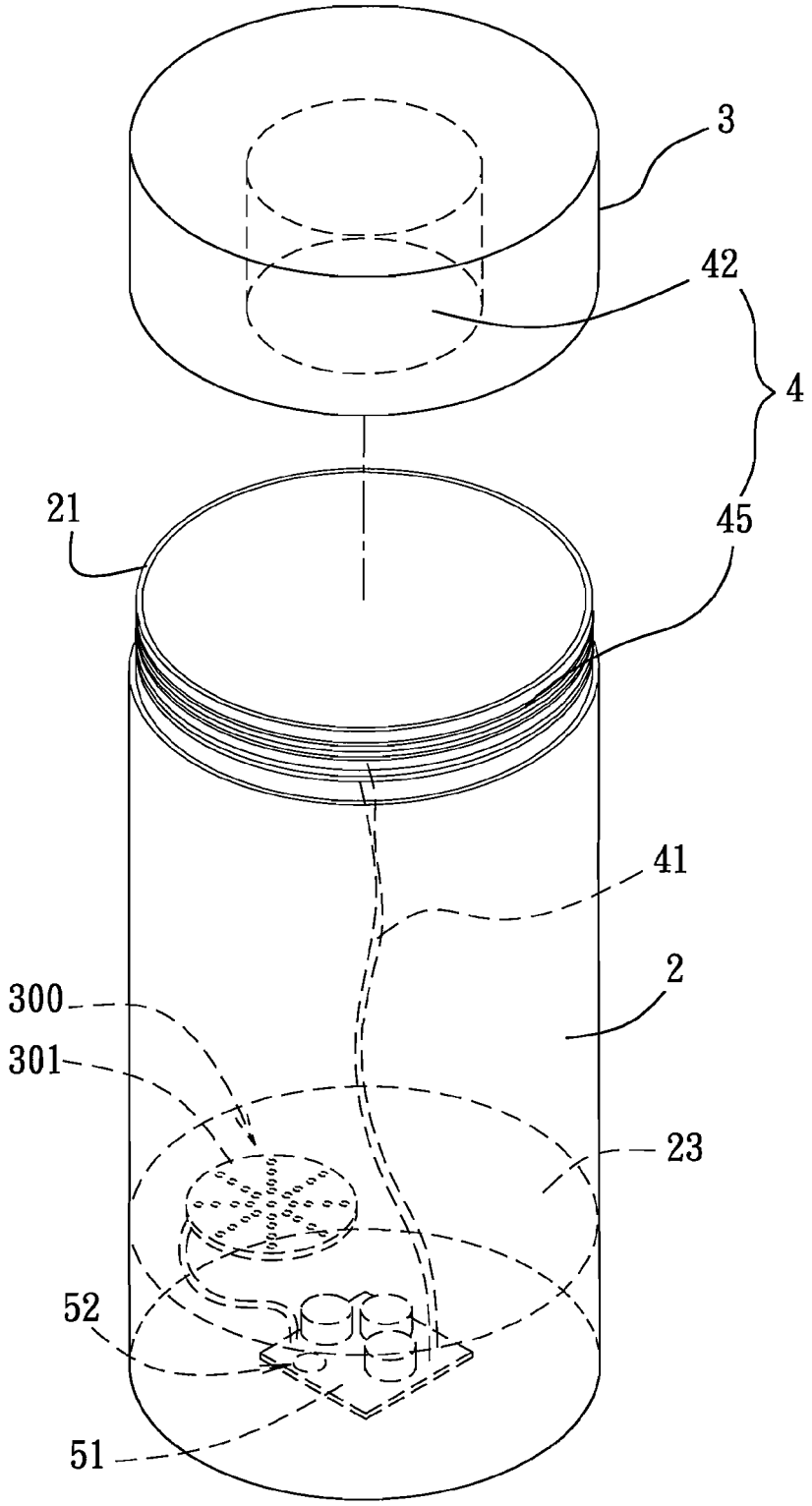
FIG. 10 is a perspective view of the twenty first preferred embodiment of the gift package according to this invention.

FIG. 10 illustrates the twenty first preferred embodiment of the gift package according to this invention. The preferred embodiment differs from the first preferred embodiment in that the switch 4 includes a magnetic core 42 mounted on an interior of the lid 3, and a conductive coil 45 wound around the open end 21 of the box body 2 and coupled electromagnetically to the magnetic core 42 and electrically to the controller 52 through the conductive lines 41. As such, movement of the lid 3 relative to the box body 2 can result in activation and deactivation of the signal output unit 300 through the interaction between the magnetic core 42 and the conductive coil 45.

Figure 11:
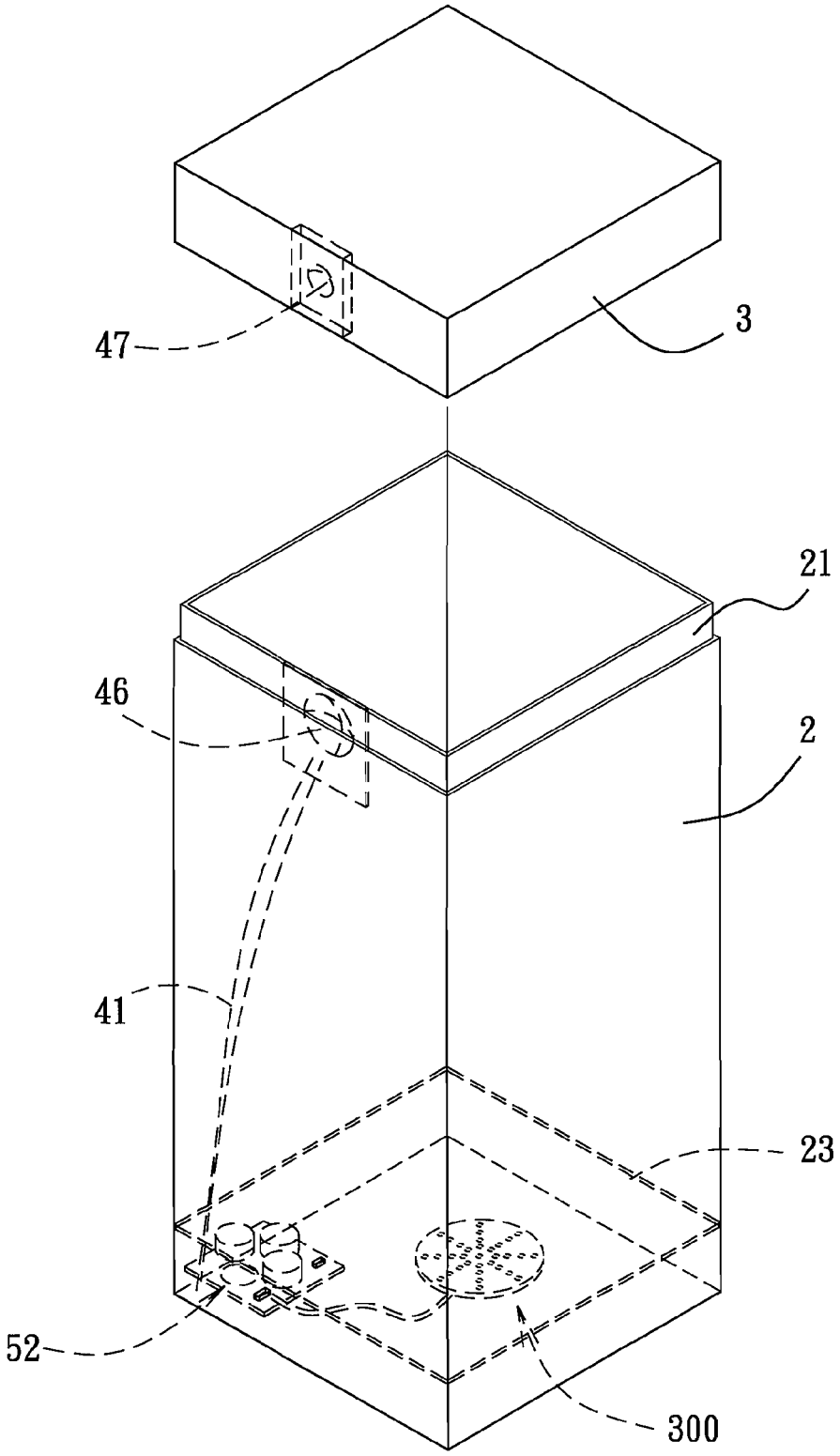
FIG. 11 is a perspective view of the twenty second preferred embodiment of the gift package according to this invention.

FIG. 11 illustrates the twenty second preferred embodiment of the gift package according to this invention. The preferred embodiment differs from the first preferred embodiment in that the switch 4 includes a radio frequency identification (RFID) transceiver 46 mounted on the open end 21 of the box body 2 and coupled electrically to the controller 52 through the conductive lines 41, and a RFID tag 47 mounted on an interior of the lid 3 and coupled to the RFID transceiver 46. As such, movement of the lid 3 relative to the box body 2 can result in activation and deactivation of the signal output unit 300 through interaction between the RFID transceiver 46 and the RFID tag 47. Note that the RFID switch has advantages, such as well concealment and ideal separating distance, as those of the reed switch 401 and the semiconductor magnetic sensitive switches as described above.

Figure 12:
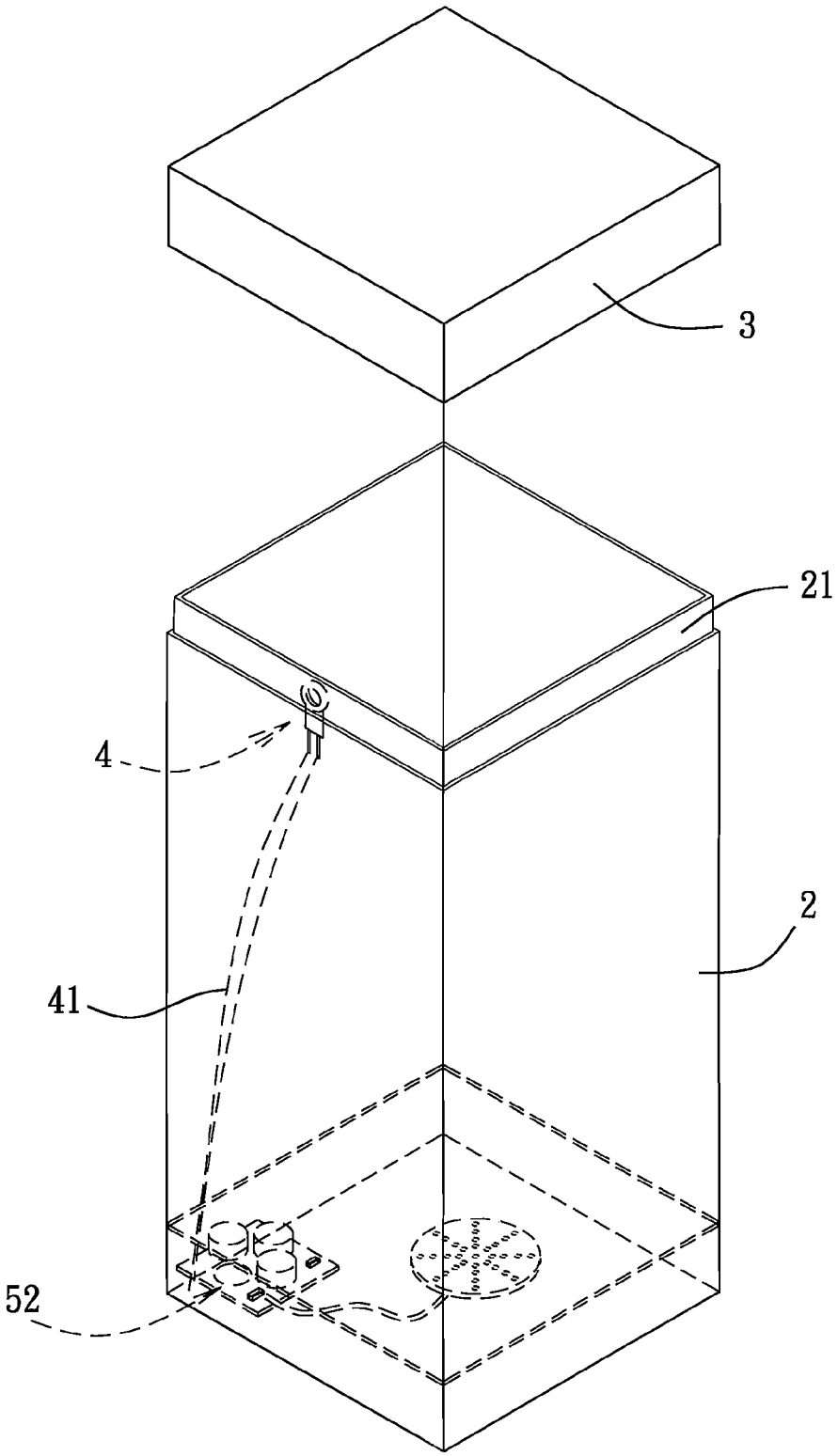
FIG. 12 is a perspective view of the twenty third preferred embodiment of the gift package according to this invention.

FIG. 12 illustrates the twenty third preferred embodiment of the gift package according to this invention. The preferred embodiment differs from the first preferred embodiment in that the switch 4 is a membrane switch mounted on the open end 21 of the box body 2 and including a conductive dome plate (not shown) and a pair of conductive strips (not shown) connected to the conductive lines 41, respectively. The conductive dome plate is resilient and is flexed to contact the conductive strips when pressed. As such, movement of the lid 3 relative to the box body 2 can result in activation and deactivation of the signal output unit 300 through interaction between the dome plate and the conductive strips.

Figure 13:
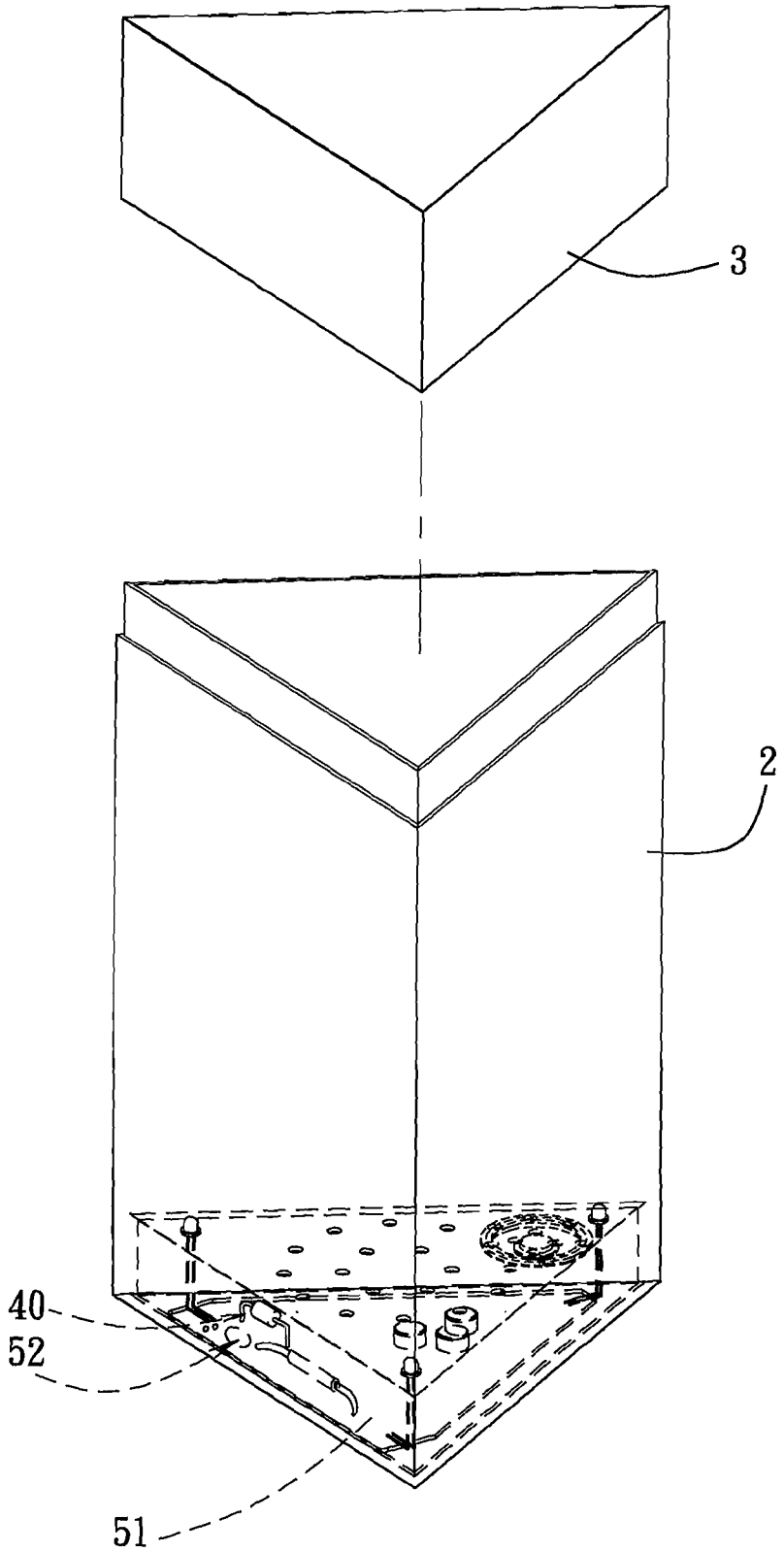
FIG. 13 is a perspective view of the twenty fourth preferred embodiment of the gift package according to this invention.

FIG. 13 illustrates the twenty fourth preferred embodiment of the gift package according to this invention. The preferred embodiment differs from the first preferred embodiment in that a shake switch 40 is further included therein. The shake switch 40 is mounted on the circuit board 51, and is used to control the operation states of the control circuit of the controller 52.

Figure 14:
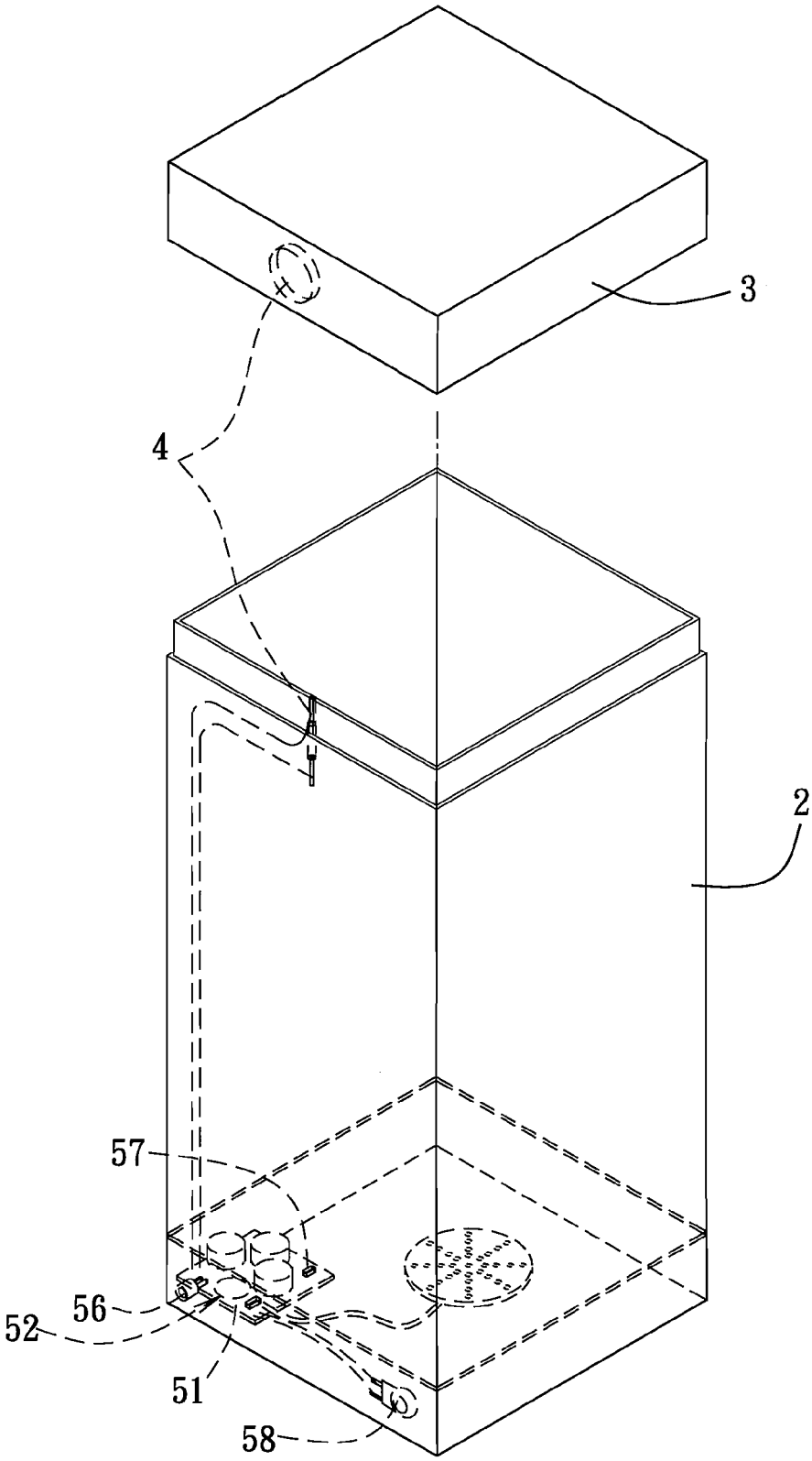
FIG. 14 is a perspective view of the twenty fifth preferred embodiment of the gift package according to this invention.

FIG. 14 illustrates the twenty fifth preferred embodiment of the gift package according to this invention. The preferred embodiment differs from the first preferred embodiment in that a microphone 56, a memory unit 57, and a record button 58 are further included therein. The microphone 56 is mounted on the box body 2 and is electrically connected to the circuit board 51. The memory unit 57 is mounted on and is electrically connected to the circuit board 51. The record button 58 is mounted on an exterior of the box body 2, and is electrically connected to the circuit board 51. Alternatively, the record button 58 can be mounted on an interior of the box body 2. As such, the memory unit 57 can be used to record acoustic data through the microphone 56 when the record button 58 is pressed. The stored acoustic data in the memory unit 57 can be played through actuation of the control circuit of the controller 52 when the lid 3 is removed from the box body 2. In this embodiment, the record button is a membrane switch.

The following preferred embodiments differ from the previous embodiments in that instead of disposing in a vertical manner, the article for the following preferred embodiments is to be placed in the gift package in a horizontal manner.

Figure 15A:
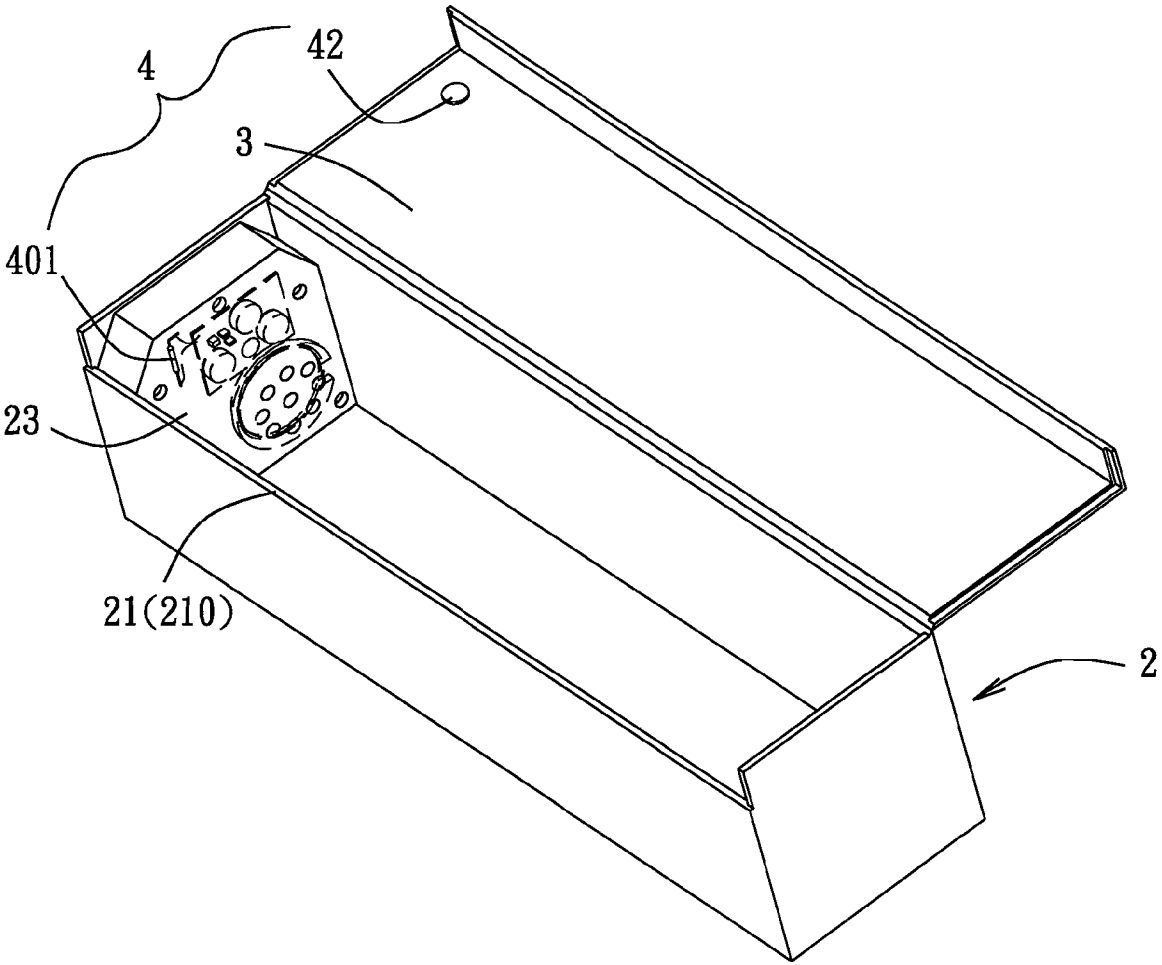
FIG. 15A is a perspective view of the twenty sixth preferred embodiment of the gift package according to this invention.
Figure 15B:
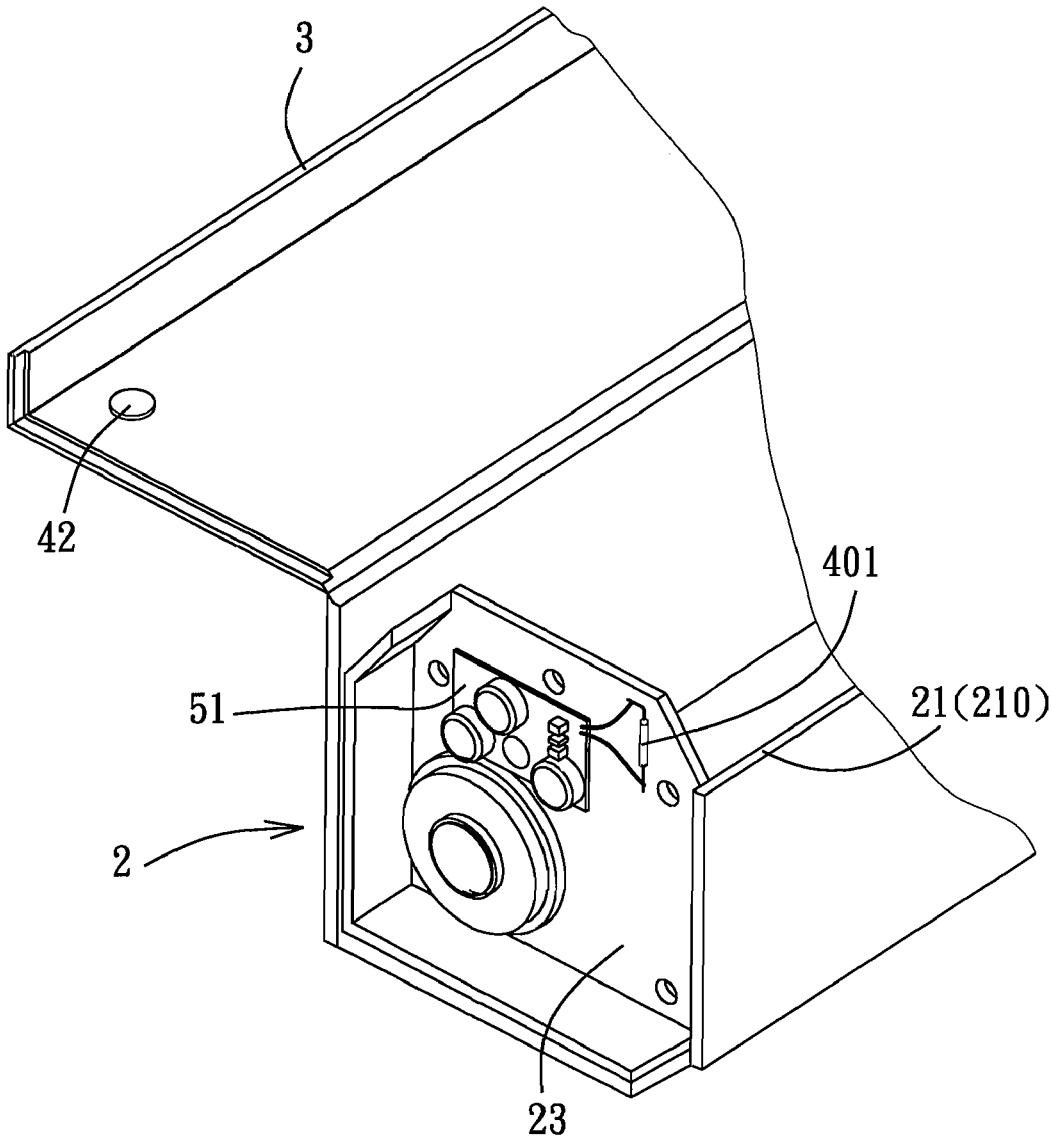
FIG. 15B is a fragmentary perspective view of the twenty sixth preferred embodiment.
Figure 15C:
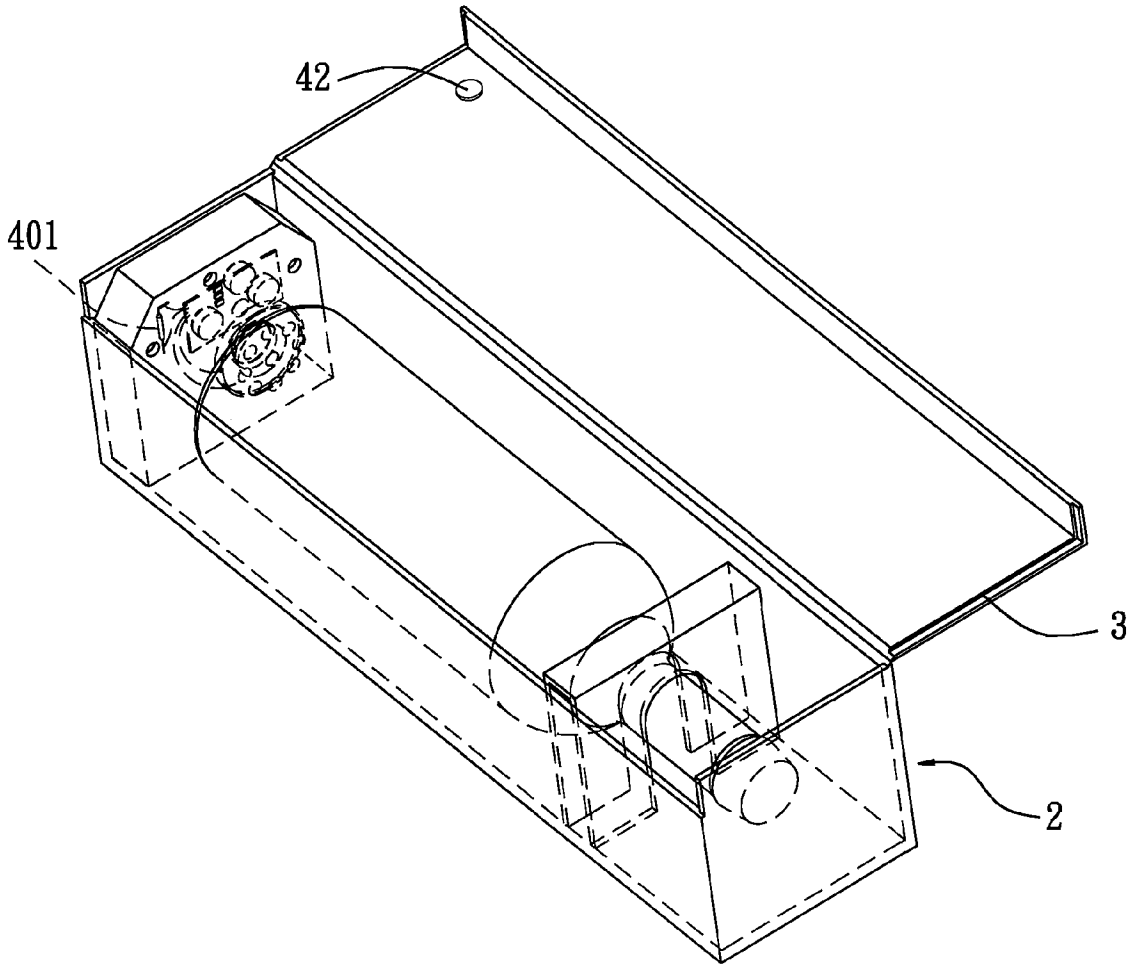
FIG. 15C is a perspective view of the twenty sixth preferred embodiment in a state where a wine bottle is disposed therein.

FIGS. 15A to 15C illustrate the twenty sixth preferred embodiment of the gift package according to this invention. This preferred embodiment differs from the first preferred embodiment in that the box body 2 is used for placement of the article, such as a wine bottle, in a horizontal manner. In this embodiment, the reed switch 401 is mounted on the partitioning plate 23 of the box body 2 at a position adjacent to the open end 21 of the box body 2 so that covering and uncovering the access opening 210 through the lid 3 results in activation and deactivation of one of the circuit states of the control circuit.

Figure 16A:
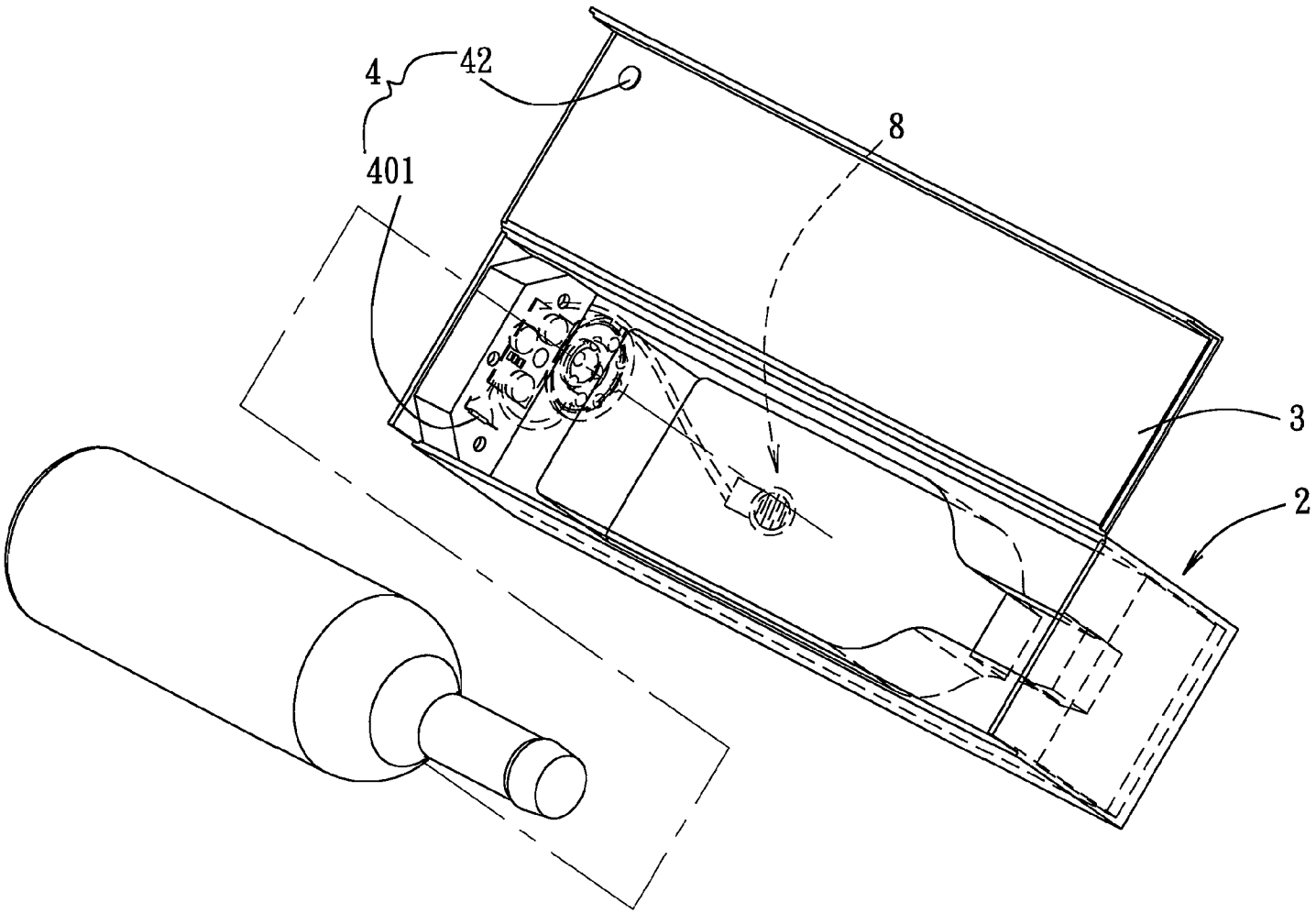
FIG. 16A is a perspective view of the twenty seventh preferred embodiment of the gift package according to this invention.
Figure 16B:
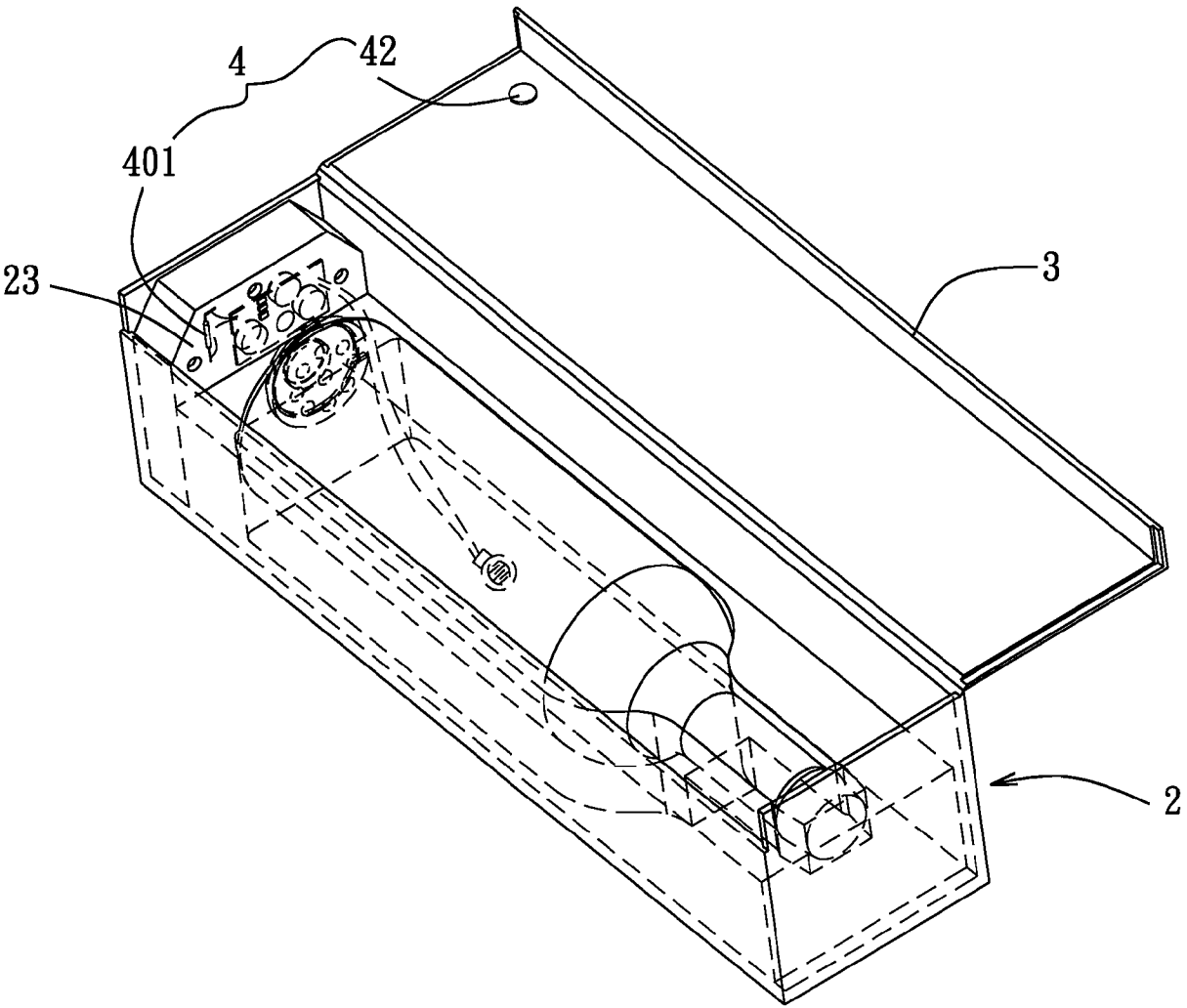
FIG. 16B is a perspective view of the twenty seventh preferred embodiment in a state where a wine bottle is disposed therein.

FIGS. 16A and 16B illustrate the twenty seventh preferred embodiment of the gift package according to this invention. This preferred embodiment differs from the twenty sixth preferred embodiment in that a second switch 8 is further included therein. In this embodiment, the second switch 8 is a membrane switch embedded in a bottom wall of the box body 2, and is actuated and deactivated through removal and placement of the article from and on the box body 2, thereby activating and deactivating another circuit state of the control circuit.

With the inclusion of the controller 52, the signal output unit 300, and the circuit actuating unit in the gift package of this invention, the appeal of the gift package is enhanced.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A gift package having circuit actuating capability and adapted to receive an article of a gift therein, said gift package comprising:

a box body defining an inner space therein and having an open end defining an access opening, and a partitioning plate that divides said inner space into first and second chambers, said first chamber being adapted to accommodate the article therein said partitioning plate being adapted to abut against the article, said box body being provided with a lid for covering and uncovering said access opening of said box body;

a signal output unit mounted in said second chamber for generating at least one of audio and video signals;

a control circuit including a circuit board mounted securely in said second chamber and provided with a controller that is electrically coupled to said signal output unit for controlling activation and deactivation of said signal output unit; and a circuit actuating unit including a switch that is coupled electrically to said control circuit, that is mounted on said box body, and that is operable through a selected one of said lid and the article in such a manner that performing a selected one of operations of uncovering said access opening and removing the article from said partitioning plate enables said controller to activate said signal output unit through said switch.

2. The gift package of claim 1, wherein said circuit actuating unit further includes a pair of conductive lines extending between and interconnecting said switch and said circuit board so that electrical connection and disconnection between said conductive lines, which correspond respectively to activation and deactivation of said signal output unit, is controlled by said switch through said controller.

3. The gift package of claim 2, wherein said switch is a reed switch mounted on said box body and disposed adjacent to said access opening of said box body, said circuit actuating unit further including a magnet mounted on said lid for coupling magnetically to said reed switch when said lid covers said access opening so that covering and uncovering of said access opening respectively result in magnetic engagement and disengagement between said magnet and said reed switch, which, in turn, respectively result in electrical connection and disconnection between said conductive lines.

4. The gift package of claim 2, wherein said switch is selected from the group consisting of a semiconductor magnetic sensitive resistor, a semiconductor magnetic sensitive diode, and a semiconductor magnetic sensitive transistor.

5. The gift package of claim 2, wherein said switch is a micro switch mounted on said box body and disposed adjacent to said access opening of said box body so that covering and uncovering of said access opening respectively result in contact and separation between said lid and said micro switch, which, in turn, respectively result in electrical connection and disconnection between said conductive lines.

6. The gift package of claim 2, wherein said switch includes a pair of spaced apart first conductive contacts that are disposed on said box body adjacent to said open end of said box body and that are respectively connected to said conductive lines, and a second conductive contact that is disposed on said lid for bridging said first conductive contacts when said lid covers said access opening so that covering and uncovering of said access opening respectively result in electrical connection and disconnection between said conductive lines.

7. The gift package of claim 6, wherein each of said first and second conductive contacts is formed of a printed conductive ink.

8. The gift package of claim 2, wherein said switch includes a first conductive contact that is disposed on said box body adjacent to said open end of said box body and that is connected electrically to one of said conductive lines, and a second conductive contact that is disposed on said lid and that is connected electrically to the other of said conductive lines for contacting said first conductive contact when said lid covers said access opening so that covering and uncovering of said access opening respectively result in electrical connection and disconnection between said conductive lines.

9. The gift package of claim 8, wherein each of said first and second conductive contacts is formed of a printed conductive ink.

10. The gift package of claim 2, wherein said switch is a light sensor disposed on said box body adjacent to said open end of said box body, connected electrically to said conductive lines, and covered by said lid when said lid covers said access opening so that covering and uncovering of said access opening respectively result in electrical connection and disconnection between said conductive lines.

11. The gift package of claim 2, wherein said switch is a light sensor mounted on an interior of said lid and connected electrically to said conductive lines so that covering and uncovering of said access opening respectively result in electrical connection and disconnection between said conductive lines.

12. The gift package of claim 2, wherein said switch includes a weight sensor that is mounted on said circuit board, that is electrically connected to said controller, and that is disposed below and that abuts against said partitioning plate, said partitioning plate being mounted movably in said inner space in said box body so that placing of the article on said partitioning plate and removal of the article from said partitioning plate respectively result in downward and upward movements of said partitioning plate, which, in turn, respectively result in activation and deactivation of said signal output unit.

* * * * *